US007113739B2

(12) United States Patent
Kawamata et al.

(10) Patent No.: US 7,113,739 B2
(45) Date of Patent: Sep. 26, 2006

(54) DIGITAL BROADCAST RECEIVER

(75) Inventors: Yukihiro Kawamata, Hitachi (JP); Kimiya Yamaashi, Hitachi (JP); Takaharu Ishida, Hitachinaka (JP); Osamu Tomobe, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 866 days.

(21) Appl. No.: 10/100,174

(22) Filed: Mar. 19, 2002

(65) Prior Publication Data

US 2003/0054758 A1 Mar. 20, 2003

(30) Foreign Application Priority Data

Sep. 19, 2001 (JP) ..... 2001-285165

(51) Int. Cl.
*H04H 1/00* (2006.01)

(52) U.S. Cl. ..... 455/3.02; 455/3.04; 455/3.06; 455/414.4

(58) Field of Classification Search ..... 455/3.04, 455/3.06, 556, 414.4, 135, 3.01, 179.1, 3.02; 725/73; 381/2; 370/328, 210; 369/7
See application file for complete search history.

(56) References Cited

U.S. PATENT DOCUMENTS

| | | | | |
|---|---|---|---|---|
| 6,064,865 | A * | 5/2000 | Kuo et al. | 455/135 |
| 6,430,505 | B1 * | 8/2002 | Green | 701/214 |
| 6,490,432 | B1 * | 12/2002 | Wegener et al. | 455/3.05 |
| 6,775,654 | B1 * | 8/2004 | Yokoyama et al. | 704/500 |
| 6,804,510 | B1 * | 10/2004 | Bates et al. | 455/414.4 |
| 6,832,070 | B1 * | 12/2004 | Perry et al. | 455/3.02 |
| 2002/0025777 | A1 * | 2/2002 | Kawamata et al. | 455/3.05 |
| 2002/0027511 | A1 * | 3/2002 | Horita et al. | 340/988 |
| 2002/0152115 | A1 * | 10/2002 | Morita et al. | 705/13 |
| 2002/0184457 | A1 * | 12/2002 | Yuasa et al. | 711/161 |
| 2004/0064507 | A1 * | 4/2004 | Sakata | 709/205 |
| 2004/0088739 | A1 * | 5/2004 | Shimoji et al. | 725/135 |
| 2005/0003808 | A1 * | 1/2005 | Bates et al. | 455/414.4 |

FOREIGN PATENT DOCUMENTS

| | | |
|---|---|---|
| JP | 10-290171 | 10/1998 |
| JP | 11-53683 | 2/1999 |
| JP | 2000-197032 | 7/2000 |
| JP | 2000-287267 | 10/2000 |
| JP | 2001-69415 | 3/2001 |
| JP | 2001-111467 | 4/2001 |
| JP | 2001-168742 | 6/2001 |
| JP | 2001-230735 | 8/2001 |
| JP | 2001-230740 | 8/2001 |

OTHER PUBLICATIONS

Japanese Office Action, dated Sep. 21, 2005.

* cited by examiner

*Primary Examiner*—Matthew Anderson
*Assistant Examiner*—Tan Trinh
(74) *Attorney, Agent, or Firm*—McDermott Will & Emery LLP

(57) ABSTRACT

A digital broadcast receiver (mobile's receiver terminal) 1 for receiving a digital broadcast signal DS carrying many contents and also outputting the content based on thus received digital broadcast signal DS, including a content accumulation portion (database) 1*c* for accumulating received contents, a reception state detection portion for detecting whether the digital broadcast signal DS can be received normally, and a switch-over portion (reproduction/switch-over portion) 1*b* for switching from output of the content received to reproduction of the content accumulated in the content accumulation portion 1*c* if the reception state detection portion detects that the digital broadcast signal cannot be received normally.

6 Claims, 24 Drawing Sheets

FIG.3

FAVORITE PROGRAM ACCUMULATION DB

1e

| PROGRAM NAME | BROADCAST DAY | BROADCAST STARTING / ENDING TIME | GENRE | PERFORMER | PRIORITY | 1E PROGRAM CONTENT DATA |
|---|---|---|---|---|---|---|
| xxxxxx | xxxx.xx.xx | xx:xx:xx-xx:xx:xx | MUSIC | xx xx.xx xx | 1 | xxx ··· |
| xxxxxx | xxxx.xx.xx | xx:xx:xx-xx:xx:xx | NEWS | xx xx | 3 | xxx ··· |
| xxxxxx | xxxx.xx.xx | xx:xx:xx-xx:xx:xx | MUSIC | xx xx.xx xx | 2 | xxx ··· |
| ⋮ | ⋮ | ⋮ | ⋮ | ⋮ | ⋮ | ⋮ |

FIG.6

ELECTRONIC PROGRAM TABLE

12:00 - 13:00
NEWS AT NOON

PERFORMER: YAMAMOTO XX
GENRE: NEWS

13:00 - 14:00
AFTERNOON MUSIC

PERFORMER: TANAKA ○○
AMUROH
GENRE: MUSIC

FIG.7

ACCUMULATED PROGRAM REPRODUCTION/
SWITCH-OVER NOTIFICATION SCREEN

INSTANTANEOUS DISCONNECTION IS DETECTED.
SWITCHES TO ACCUMULATED PROGRAM.

109a

FAVORITE PROGRAM REGISTRATION SCREEN AND SCREEN TRANSITION (EXAMPLE 1)

FIG.12

113

FAVORITE MUSIC ACCUMULATION DB

| CONTENT ID | MELODY NAME | SINGER NAME OR GROUP NAME | TIME | ACCUMULATION DAY | ACCUMULATION TIME | MUSIC CONTENT DATA |
|---|---|---|---|---|---|---|
| 0153-2222-1111-5555 | xxxxxx | xx xx | xx:xx | xxxx.xx.xx | xx:xx:xx | xxx ··· |
| 0152-7777-6666-3333 | xxxxxx | xx xx | xx:xx | xxxx.xx.xx | xx:xx:xx | xxx ··· |
| ··· | ··· | ··· | ··· | ··· | ··· | ··· |

FIG.19

120

LATEST MUSIC ACCUMULATION DE

| ACCUMULATION DAY | ACCUMULATION TIME | CONTENT ID | MELODY NAME | SINGER NAME OR GROUP NAME | DURATION | MUSIC CONTENT DATA |
|---|---|---|---|---|---|---|
| xxxx.xx.xx | xx:xx:xx | xxxx-xxxx-xxxx-xxxx | xxxxxx | xx xx | xx:xx | xxx ··· |
| xxxx.xx.xx | xx:xx:xx | xxxx-xxxx-xxxx-xxxx | xxxxxx | xx xx | xx:xx | xxx ··· |
| ··· | ··· | ··· | ··· | ··· | ··· | ··· |

INSTANTANEOUS DISCONNECTION-BASED ACCUMULATED-MUSIC REPRODUCTION/
SWITCH-OVER NOTIFICATION SCREEN AND SCREEN TRANSITION
(IN THE CASE WHERE THE SAME MUSIC WAS FOUND)

INSTANTANEOUS DISCONNECTION-BASED ACCUMULATED-MUSIC REPRODUCTION/ SWITCH-OVER NOTIFICATION SCREEN AND SCREEN TRANSITION (IN THE CASE WHERE THE SAME MUSIC WAS NOT FOUND)

DIGITAL BROADCAST RECEIVER

BACKGROUND OF THE INVENTION

1. Field of the Invention

The present invention relates to a digital broadcast receiver that can output a content even when it cannot receive a digital broadcast signal normally.

2. Description of the Related Art

Satellite digital broadcasting has started recently and, further, digital terrestrial broadcasting is expected to start. As such, a digital broadcast receiver has been developed that can receive a digital broadcast signal carrying a number of multiplexed contents such as music, news, sports, etc. and then demodulate it to output these contents. Accordingly, with prevalence of such digital broadcasting and developments of such digital broadcast receiver, even a mobile such as a automobile is expected to receive a digital broadcast signal to output music etc.

SUMMARY OF THE INVENTION

In view of the above, it is an object of the present invention to provide a digital broadcast receiver that can output an content even when it cannot receive a digital broadcast signal normally.

When a digital broadcast signal is being received by an automobile, however, the reception position changes all the time while the automobile is moving. Accordingly, when the automobile enters a tunnel or a building shade, the received radio wave of the digital broadcast signal is weakened by these obstacles, sometimes to such an extent that the signal cannot be received at all. In such a case, the digital broadcast receiver cannot demodulate the digital broadcast signal to get complete content data, thus giving rise to sound-out that the sound is not raised at all when music, news, etc. is being output audibly. Sound-out gives an uncomfortable feeling to the driver. In this connection, even if noise is raised when the received radio wave of an analog broadcast signal for AM or FM broadcasting is weakened, music or news can be output to a certain extent of audibility, thus giving a less uncomfortable feeling to the driver.

The present invention solving the above problems consists of a digital broadcast receiver that receives a digital broadcast signal carrying a number of contents and also outputs the contents based on thus received digital broadcast signal, specifically by accumulating the received contents beforehand so that when it has detected disabled normal reception of the digital broadcast signal, it may switch to the reproduction of these accumulated contents.

By this digital broadcast receiver, even when a digital broadcast signal cannot be received normally, contents accumulated beforehand can be reproduced and output, thus avoiding interruption of a content output.

Other objects, features and advantages of the invention will become apparent from the following description of the embodiments of the invention taken in conjunction with the accompanying drawings.

BRIEF DESCRIPTION OF THE DRAWINGS

FIG. 3 is a data configuration diagram for showing a favorite program accumulation DB of the mobile's receiver terminal of FIG. 2;

FIG. 6 is an illustration for showing an example of an electronic program guide;

FIG. 7 is an illustration for showing a screen for posting reproduction/switch-over to an accumulated program displayed at a display of the mobile's receiver terminal of FIG. 2;

FIG. 12 is a data configuration diagram for showing a favorite music accumulation DB of the mobile's receiver terminal of FIG. 11;

FIG. 19 is a data configuration diagram for showing a latest music accumulation DB of the mobile's receiver terminal of FIG. 18;

DESCRIPTION OF THE EMBODIMENTS

Figure 1:
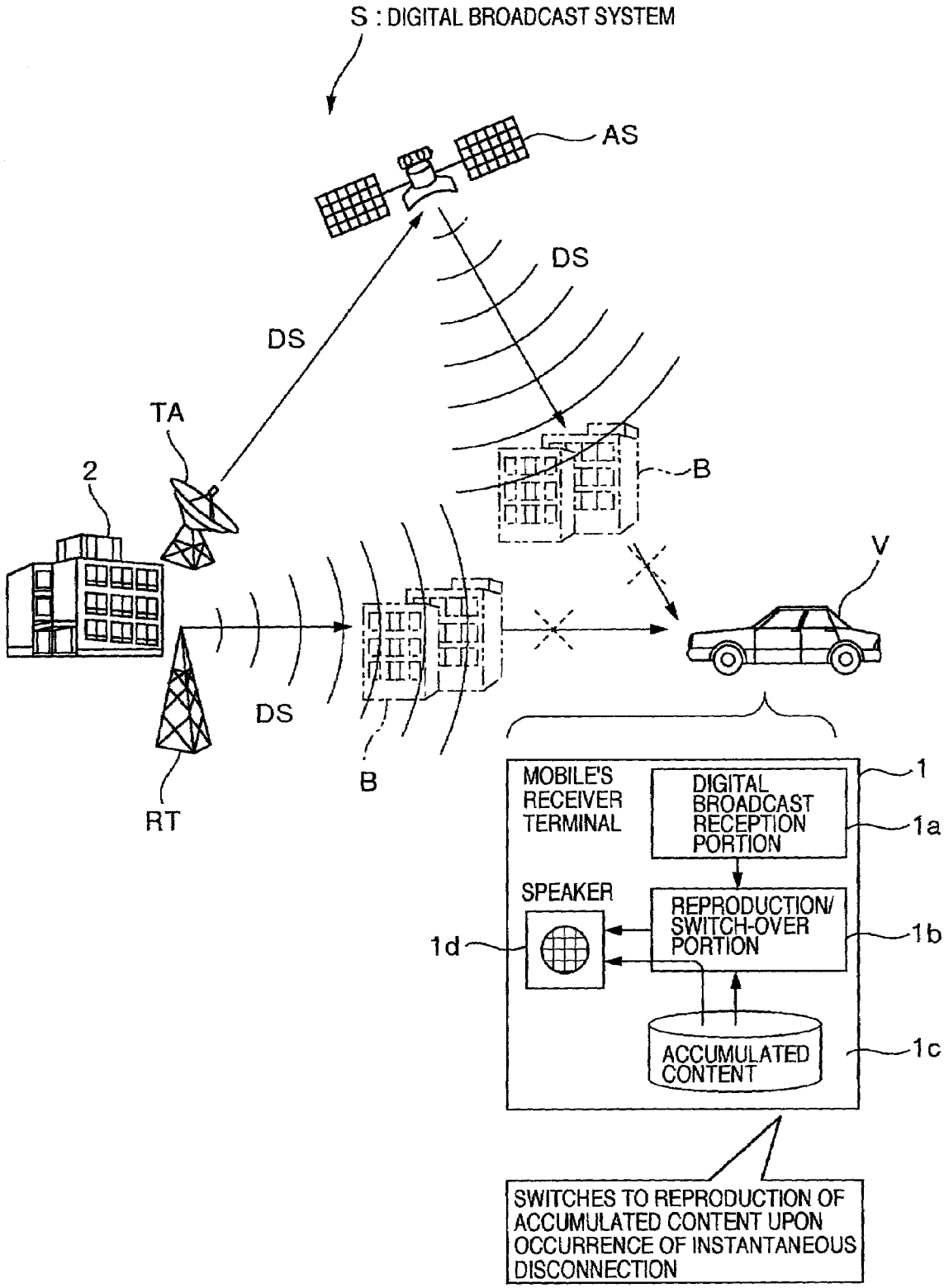
FIG. 1 is an overall configuration diagram for showing a digital broadcast system related to an embodiment.

The following will describe embodiments of a digital broadcast receiver related to the present invention with reference to the drawings.

A digital broadcast receiver related to the present invention receives a digital broadcast signal carrying a number of contents and also outputs the contents based on thus received digital broadcast signal such that it can output the contents even if it cannot received the digital broadcast signal normally owing to an obstacle, a trouble in the broadcasting facilities, etc.

To this end, the digital broadcast receiver comprises: content accumulation means for accumulating received contents; reception state detection means for detecting whether a digital broadcast signal can be received normally; and switch-over means for switching in reproduction from a content being received to a content accumulated in the content accumulation means if the reception state detecting means-detected that the digital broadcast signal cannot be received normally, whereby the switched content accumulated beforehand can be reproduced and output, thus avoiding interruption of content output even when the digital broadcast signal cannot be received normally. This digital broadcast receiver may further comprise: electronic program guide acquisition means for acquiring an electronic program from the digital broadcast signal; program registration means for registering information of a viewer's favorite program; program information storage means for storing information of a program registered by the program registration means; and program extraction means for extracting a content of a program stored in the program information storage means from received contents to then accumulate this extracted program content in the content accumulation means, so that any program accumulated by a viewer can be selected, to output his favorite program even when the accumulated content is reproduced. Alternatively, this digital broadcast receiver comprises: content ID acquisition means for acquiring a content IS assigned to each content based on the digital broadcast signal; content ID registration means for registering a content ID of a viewer's favorite content; content ID storage means for storing a content ID registered in the content ID registration means; and content extraction means for extracting a content having a content ID that coincides with a content ID stored in the content ID storage means from received contents to then accumulate thus extracted content in the content accumulation means, so that a content accumulated by a viewer can be selected by its content ID, thus outputting his favorite content even when accumulated contents are reproduced.

Furthermore, this digital broadcast receiver comprises: content accumulation means for accumulating a received content; reception state detection means for detecting whether a digital broadcast signal can be received normally; same-content detection means for detecting from the content accumulation means the same content as that being output based on the digital broadcast signal as received; switch-over means for switching from a content being output to the same content as that detected by the same-content detection means if the reception state detection means detected that the digital broadcast signal cannot be received normally, so that even if a received content being viewed by a viewer who has selected the relevant channel etc. cannot be output, the same content as this content can be extracted from accumulated contents can be extracted and reproduced in output continuously.

Furthermore, this digital broadcast receiver comprises: reception state detection means for detecting whether a digital broadcast signal can be received normally; communication means for communicating with a recorded-content reproducer as far as it can communicate with the digital broadcast receiver; reproducer search means for searching for the recorded-content reproducer via the communication means; and a switchover means for switching from a received content to a content being reproduced by the recorded-content reproducer if the reception state detection means detected that the digital broadcast signal cannot be received normally, so that a content reproduced by the peripheral recorded-content reproducer of the digital broadcast receiver can be output, thus eliminating necessity of accumulating a contents in the receiver.

Further, said digital broadcast receiver comprises: current-position acquisition means for acquiring the current position of a mobile such as an automobile to which it is mounted; and reception state prediction means for predicting whether a digital broadcast signal can be received normally based on a current position acquired by the current-position acquiring means and map data, so that if the reception state prediction means predicted that the digital broadcast signal cannot be received normally, the switch-over means can switches from a received content to a reproduced content, thus outputting the reproduced content before the content output is interrupted, by predicting a tunnel etc. which may disable reception of the digital broadcast signal.

It is here to be noted that the mobile refers to a substance that is mounted with or carries the digital broadcast receiver, including an automobile, a train, a human being, etc.

Furthermore, said digital broadcast receiver receives a digital broadcast signal which is transmitted via an artificial satellite such as a highly-elliptic orbit satellite. Alternatively, said digital broadcast receiver receives a digital broadcast signal sent by digital terrestrial broadcasting.

According to this embodiment, the digital broadcast receiver related to the present invention is applied to a mobile's receiver terminal which is mounted to an automobile for receiving a digital broadcast signal to audibly output a content based on this digital broadcast signal. By this embodiment, the digital broadcast signal is generated at a content distribution station and then distributed by satellite digital broadcasting by way of an artificial satellite or by digital terrestrial broadcasting by way of a radio wave tower. It is here to be noted that this embodiment has five sub-embodiments with differences in configuration of the mobile's receiver terminal and the content distribution station.

First, an overall configuration of a digital broadcast system S related to this embodiment. FIG. 1 is an overall configuration diagram for showing the digital broadcast system S.

In the digital broadcast system S, a content distribution station 2 codes and multiplexes a content such as music or news to generate a digital broadcast signal DS, which is then transmitted via a transmission antenna TA by satellite digital broadcasting by use of an artificial satellite AS or by digital terrestrial broadcasting by use of a radio wave tower RT. Then, in the digital broadcast system S, the digital broadcast signal DS is received at a mobile's receiver terminal 1 mounted to an automobile V to then be demodulated in order to output the content audibly. It is here to be noted that the artificial satellite AS is a Highly Elliptical Orbit (HEO) satellite.

It is here to be noted that in this embodiment, the mobile's receiver terminal 1 corresponds to a digital broadcast receiver described in the claim and the automobile V, to a mobile described in the same.

Generally, the mobile's receiver terminal 1 receives the digital broadcast signal DS at a reception antenna (not shown) of a digital broadcast reception portion 1*a* to then demodulate this digital broadcast signal DS, thus extracting a number of contents. As such, the mobile's receiver terminal 1 audibly outputs the content of a channel selected by a driver (or fellow passenger) via a reproduction/switch-over portion 1*b* from a speaker id. Moreover, the mobile's receiver terminal 1 accumulates received contents in a database (hereinafter abbreviated as DB) 1*c*.

The automobile V, however, may sometimes enter a shadow of a building B or a tunnel (not shown). In such a case, the mobile's receiver terminal 1 has a weakened received radio wave of the digital broadcast signal DS or cannot receive it at all. To solve this problem, the mobile's receiver terminal 1 uses the reproduction/switch-over portion 1*b* to switches an audible output from a content being received to a content accumulated beforehand to then reproduce this accumulated one and output it from the speaker 1*d*.

The digital broadcast signal DS is described as follows.

The digital broadcast signal is obtained by modulating a transport stream (hereinafter abbreviated as TS (Transport Stream)) so that it may fit to satellite broadcasting or ground-wave broadcasting. A single TS is an aggregate of a number of TS packets (with a data length of 188 bytes) each consisting of a TS packet header and TS data. The TS packet header sets a packet ID number for identifying the TS packet and information for prescribing the property of the packet. The TS data consists of an adaptation field and/or payload. The adaptation field stores the accessory information related to an individual stream such as a change in the system clock signal or the invalid data for adjusting the data length of the TS packet to 188 bytes. The payload stores a section or a PES (Packetized Elementary stream) packet. The section has a syntax configuration used to contain data in a TS packet. The PES packet consists of a PES packet header and PES data. The PES packet header sets a start code, a stream ID, a packet length, a CRC (Cyclic Redundancy Check) flag, etc. The PES data stores a plurality of sub-divided streams of an image, speech, etc. These individual streams of an image, speech, etc. are stored in a distributed manner into the payloads of a plurality of TS packets having the same packet ID number. Each of the individual streams of an image, speech, etc. is a coded stream obtained by compressing analog data of a content such as music, news, sports, a drama, etc. into codes. It is here to be noted that the CRC flag is used to check whether received data has an error.

The mobile's receiver terminal 1 has a buffer for temporarily storing a digital broadcast signal DS (TS packet) which lasts for a few seconds or so (calculated as output time) to thereby output a content of the buffered TS packet. As such, even when such a content as sports, news, etc. is broadcast live, the mobile's receiver terminal 1 outputs the content a few seconds delayed.

First Embodiment

The following will describe the first embodiment.

Figure 2:
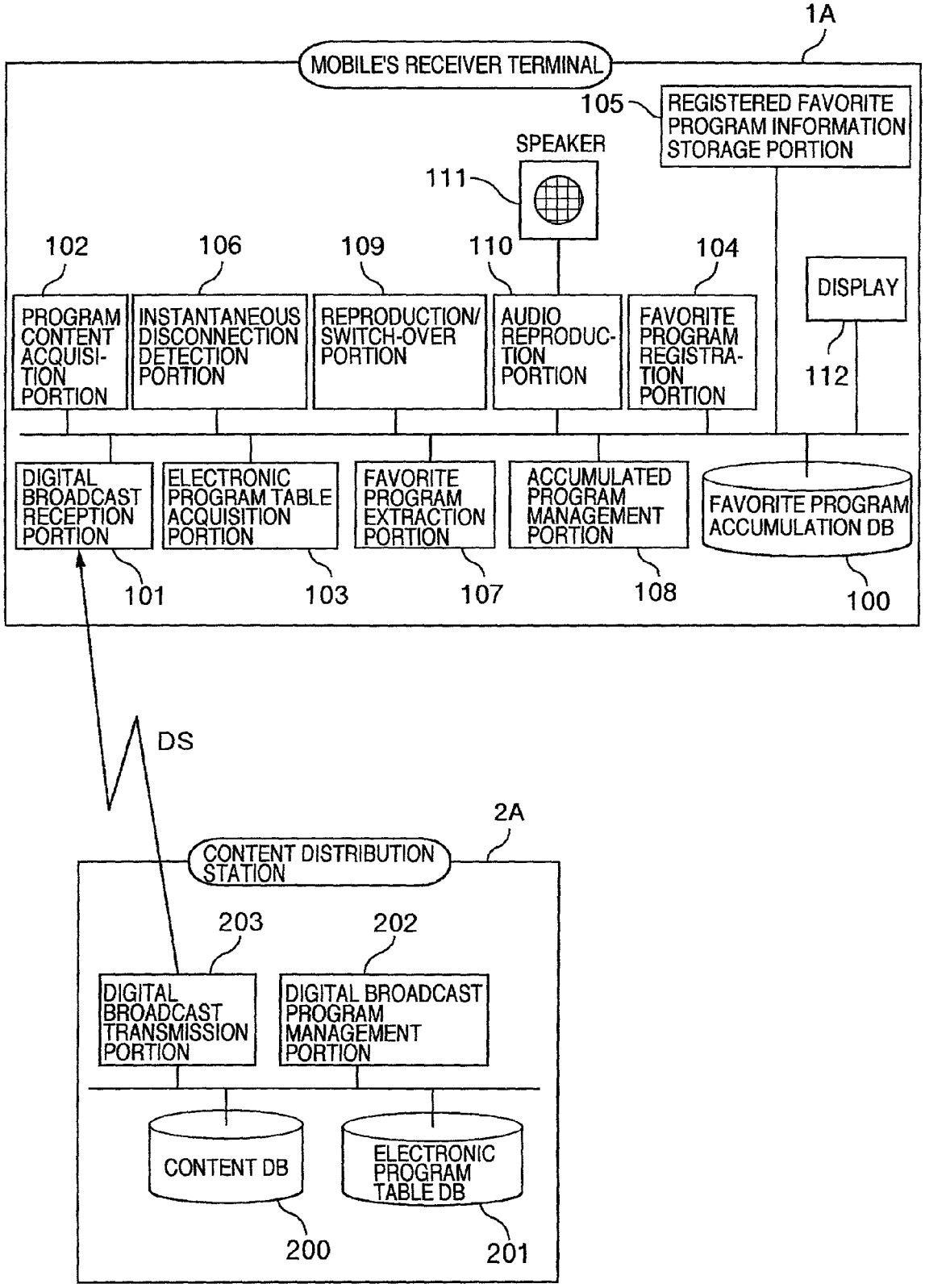
FIG. 2 is an internal configuration diagram for showing a mobile's receiver terminal and a content distribution station related to a first embodiment.

First, an internal configuration of a content distribution station 2A is described as follows. FIG. 2 is an internal configuration diagram of a mobile's receiver terminal 1A and a content distribution station 2A related to the first embodiment.

The content distribution station 2A is mainly comprised of a content DB200, an electronic program guide DB201, a digital program management portion 202, and a digital broadcast transmission portion 203. As such, the content distribution 2A is provided with a distribution server, a variety of circuits, a memory, a transmission antenna, etc., which are not shown.

The content DB200 is described as follows.

The content DB200 is constituted in a hard disk device etc., for storing contents data (compressively coded digital data) of a program and program information. The program information contains, a program name, a broadcasting day, broadcast starting time/ending time, a program genre, a program performer, etc.

The electronic program guide DB201 is described as follows.

The electronic program guide DB201 is constituted in a hard disk device etc., for storing data (compressively coded digital data) of an electronic program guide. The electronic program guide is created according to a schedule of programs, indicating the information of programs in a tome series for each channel as shown in FIG. 6 for example, which program information containing broadcast starting time/ending time, a program name, a program performer, a program genre, etc. FIG. 6 is an example of the electronic program guide.

The digital broadcast program management portion 202 is described as follows.

The digital broadcast program management portion 202 creates an electronic program guide according to an organized program schedule and also stores thus created electronic program guide in the electronic program guide DB. Furthermore, the digital broadcast program management portion 202 compressively codes analog data of a program which is made according to a program schedule and then stores thus compressively coded digital content data and its program information into the content DB200. Further, the digital broadcast program management portion 202 selects a content of a program stored in the content DB200 according to a program schedule to sub-divide the compressively coded individual stream (content data) into a plurality of PES packets. Moreover, the digital broadcast program management portion 202 extracts an electronic program guide stored in the electronic program guide DB201 to sub-divide a compressively coded individual stream (data of the electronic program guide) into a plurality of PES packets. The digital broadcast program management portion 202 then multiplexes the PES packets of a number of contents and the PES packets of the electronic program guide to thereby create a TS.

The digital broadcast transmission portion 203 is described as follows.

The digital broadcast transmission portion 203 modulates a TS created by the digital broadcast program management portion 202 into such a digital broadcast signal DS that fits satellite broadcasting or ground-wave broadcasting. Then, the digital broadcast transmission portion 203 transmits this digital broadcast signal DS through the above-mentioned transmission antenna thereof to the artificial satellite or the radio wave tower RT (see FIG. 1).

By referring to FIG. 2, the following will describe the internal configuration of the mobile's receiver terminal 1A.

The mobile's receiver terminal 1A mainly comprises a favorite program accumulation DB100, a digital program reception portion 101, a program content acquisition portion 102, an electronic program guide acquisition portion 103, a favorite program registration portion 104, a registered favorite program information storage portion 105, an instantaneous disconnection detection portion 106, a favorite program extraction portion 107, an accumulated program management portion 108, a reproduction/switch-over portion 109, and an audio reproduction portion 110. As such, the mobile's receiver terminal 1A is equipped with an MPU (Micro Processing Unit), a RAM (Random Access Memory), a variety of circuits, a memory, a reception antenna, a user interface (operation portion), a speaker 111, a display 112, etc., which are not shown.

According to the first embodiment, the favorite program accumulation DB100 corresponds to claimed content accumulation means, the instantaneous disconnection detection portion 106 corresponds to claimed reception state detection means, the reproduction/switch-over portion 109 corresponds to claimed switch-over means, the electronic program guide acquisition portion 103 corresponds to claimed electronic program guide acquisition means, the favorite program registration portion 104 corresponds to claimed program registration means, the registered favorite program information storage portion 105 corresponds to the claimed program information storage means, and the favorite program extraction portion 107 and the accumulated program management portion 108 correspond to the claimed program extraction means.

The favorite program accumulation DB100 is described as follows.

The favorite program accumulation DB100 is constituted in a hard disk device etc., for storing the content data of a favorite program selected by the driver (or fellow passenger) and the program information. Specifically, as shown in FIG. 3, it stores a program name, a broadcasting day, a broadcast staring time/ending time, a genre, a performer, a priority, and program content data. The priority relates to reproduction of a program accumulated in the favorite program accumulation DB100 and may be set by a person who selected his favorite program or based on an order in which programs are accumulated by the mobile's receiver terminal 1A. FIG. 3 is a data configuration diagram of the favorite program accumulation DB of the mobile's receiver terminal 1A.

The digital broadcast reception portion 101 is described as follows.

The digital broadcast reception portion 101 receives through the above-mentioned reception antenna thereof the digital broadcast signal DS transmitted from the artificial satellite AS or the radio wave tower RT (see FIG. 1). Then, the digital broadcast reception portion 101 amplifies thus received digital broadcast signal DS and further modulates it into a TS.

The program content acquisition portion 102 is described as follows.

The program content acquisition portion 102 takes out a packet ID number of each TS packet from the TS modulated by the digital broadcast reception portion 101 and also a stream ID of each PES packet. The program content acquisition portion 102 then retrieves such a stream ID that corresponds to a program currently selected by the driver (or fellow passenger) from thus obtained stream ID's. It is here to be noted that the program currently selected by the driver (or fellow passenger) refers to a program currently broadcast through a channel selected by the mobile's receiver terminal 1A. Subsequently, based on the packet ID number of a TS packet having thus retrieved stream ID, the program content acquisition portion 102 extracts all TS packets that have this packet ID from the TS. Further, the program content acquisition portion 102 sequentially links the PES data pieces of the PES packet of thus extracted TS packets to thereby create program content data sequentially.

The electronic program guide acquisition portion 103 is described as follows.

The electronic program guide acquisition portion 103 takes out a packet ID number of each TS packet from the TS modulated by the digital broadcast reception portion 101 and also a stream ID of each PES packet. The electronic program guide acquisition portion 103 then retrieves such a stream ID that corresponds to an electronic program guide from thus obtained stream ID's. Subsequently, based on the packet ID number of a TS packet having thus extracted stream ID, the electronic program guide acquisition portion 103 extracts all TS packets that have this packet ID from the TS. Further, the electronic program guide acquisition portion 103 sequentially links the PES data pieces of the PES packet of thus extracted TS packets to thereby create an electronic program guide sequentially.

The favorite program registration portion 104 is described as follows.

Figure 8:
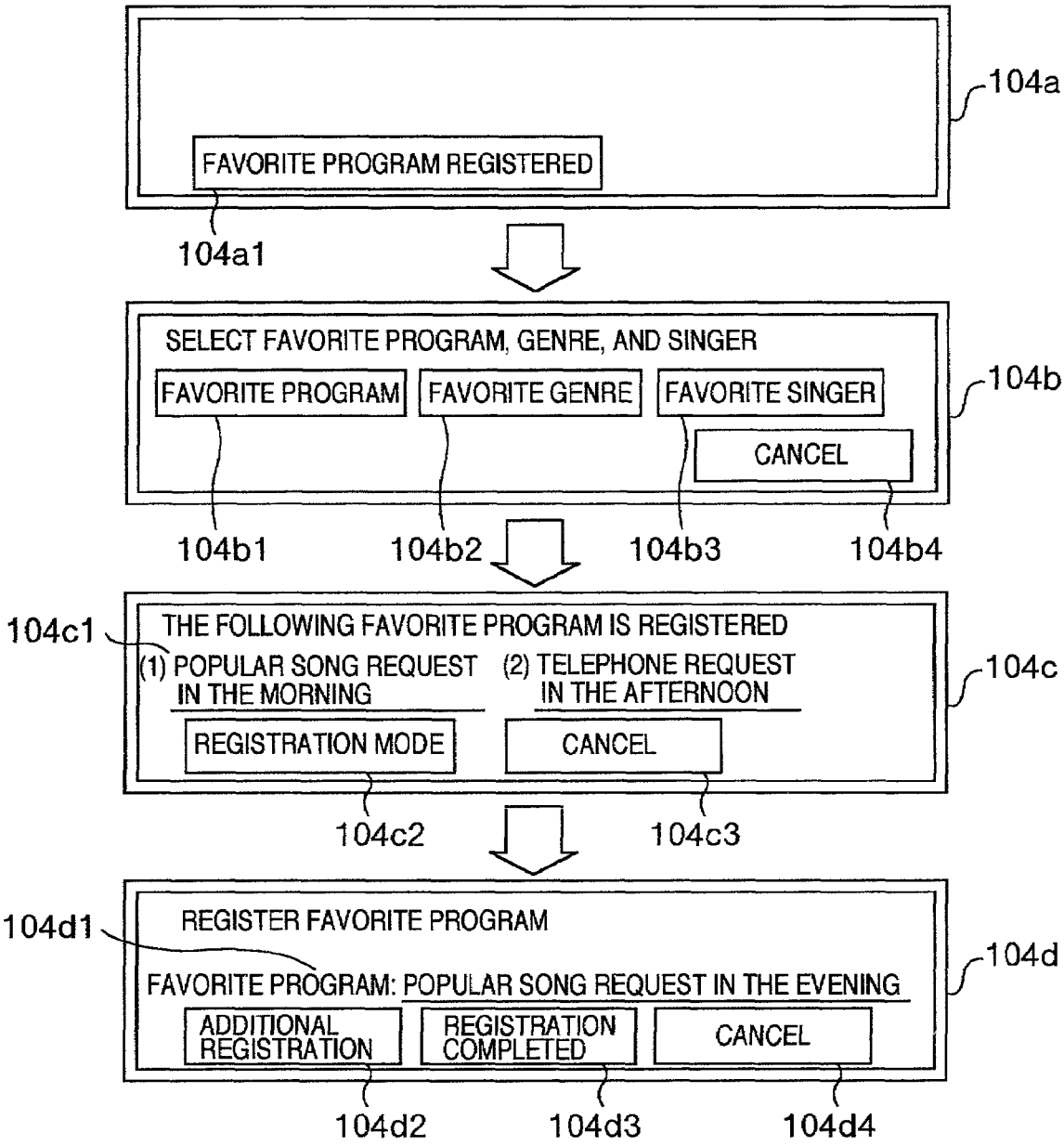
FIG. 8 is an illustration for showing example 1 of a registration screen and a screen transition of a favorite program displayed at the display of the mobile's receiver terminal of FIG. 2.

The favorite program accumulation portion 104 is provided with the above-mentioned user interface (operation portion) and a display 112 so that the driver (or fellow passenger) can register information of his favorite program. When a favorite program registration button (not shown) of the user interface is pressed, the favorite program registration portion 104 displays at the display 112 a favorite program registration initial screen 104*a* having a favorite program registration button 104*a*1 (see FIG. 8). When the favorite program registration button 104*a*1 is pressed on the favorite program registration initial screen 104*a* is pressed, the favorite program registration portion 104 displays at the display 112 a favorite program selection screen 104*b* having a favorite program button 104*b*1, a favorite genre button 104*b*2, a favorite singer button 104*b*3, and a cancel button 104*b*4 (see FIG. 8). FIG. 8 shows example 1 of the registration screen and the screen transition of a favorite program displayed at the display 112 of the mobile's receiver terminal 1A.

When the favorite program button **104*b*1 is pressed on the favorite program selection screen 104*b* further, the favorite program registration portion 104 displays at the display 11*a* a favorite program confirmation screen 104*c* having a registered program name area 104*c*1 indicating the name of a currently registered favorite program ((1) Popular song request in the morning in the example of FIG. 8), a registration mode button 104*c*2, and a cancel button 104*c*3 (see FIG. 8). When the registration mode button 104*c*2 is pressed on the favorite program confirmation screen 104*c*, the favorite program registration portion 104 displays at the display 112 a favorite program registration screen 104*d* having a favorite program registration area 104*d*1, a registration completion button 104*d*2, an additional registration button 04*d*3, and a cancel button 104*d*4 (see FIG. 8). When the registration mode button 104*c*2 is pressed on the favorite program confirmation screen 104*c*, the favorite program registration portion 104 displays at the display 112 a favorite program registration screen 104*d* having a favorite program registration area 104*d*1, a registration completion button 104*d*2, an additional registration button 104*d*3, and a cancel button 104*d*4 (see FIG. 8). When a favorite program (Popular song request in the example of FIG. 8) is input to the favorite program registration area 104*d*1 and then the additional registration button 104*d*3 is pressed, the favorite program registration portion 104 retrieves the program input in the favorite program registration area 104*d*1 from the electronic program guide and then stores the information of that program in the registered favorite program information storage portion 105. It is here to be noted that the favorite program registration area 104*d*1** may be adapted to display programs so that any of them can be selected utilizing the electronic program guide.

Figure 9:
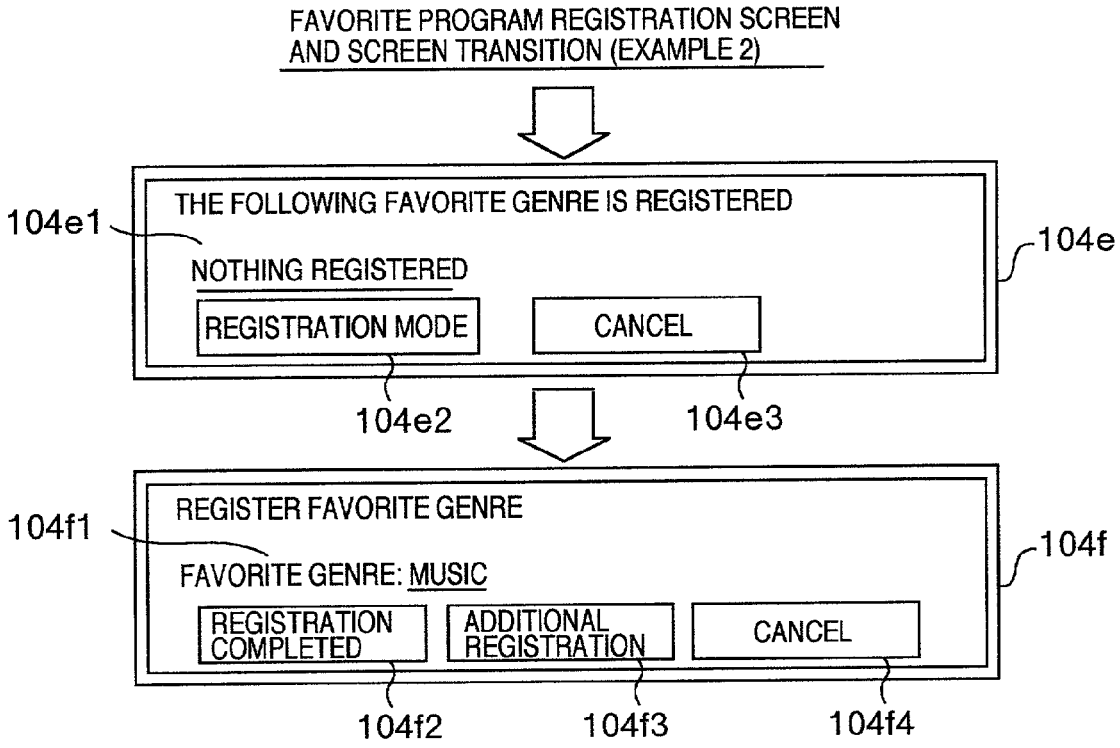
FIG. 9 is an illustration for showing example 2 of the registration screen and the screen transition of a favorite program displayed at the display of the mobile's receiver terminal of FIG. 2.

When the favorite genre button **104*b*2 is pressed on the favorite program selection screen 104*b* (see FIG. 8), on the other hand, the favorite program registration portion 104 displays at the display 112 a favorite genre confirmation screen 104*e* having a registered genre area 104*e*1 showing a currently registered genre (Nothing registered in the example of FIG. 9), a registration mode button 104*e*2, and a cancel button 104*e*3 (see FIG. 9). When the registration mode button 104*e*2 is pressed on the favorite genre confirmation screen 104*e*, the favorite program registration portion 104 displays at the display 112 a genre registration screen 104*f* having a favorite genre registration area 104*f*1, a registration completion button 104*f*2, an additional registration button 104*f*3, and a cancel button 104*f*4 (see FIG. 9). When a favorite genre (music in the case of FIG. 9) is input to the favorite genre registration area 104*f*1 and the additional registration button 104*f*3 is pressed, the favorite program registration portion 104 retrieves a program of the genre input in the favorite genre registration area 104*f*1 from the electronic program guide and then stores information of thus retrieved program in the registered favorite program information storage portion 105 utilizing the electronic program guide. It is here to be noted that the favorite genre registration area 104 may be adapted to display genres so that any of them can be selected. FIG. 9 shows example 2 of the registration screen and the screen transition of a favorite program displayed at the display 112 of the mobile's receiver terminal 1**A.

Figure 10:
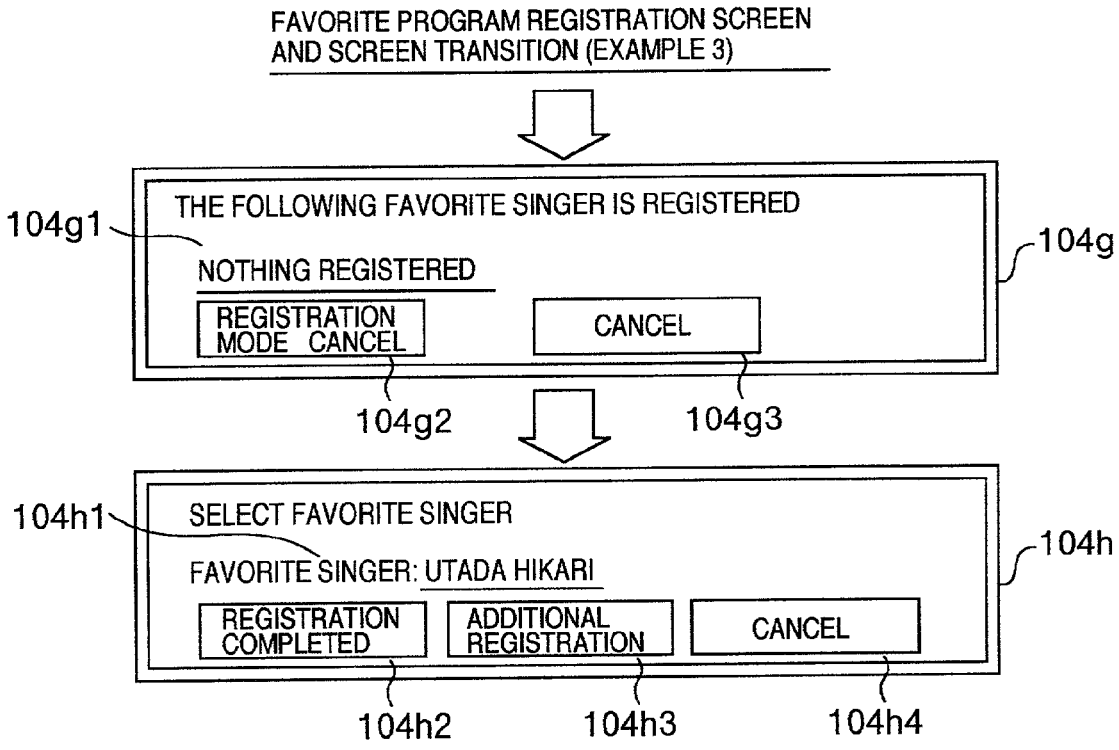
FIG. 10 is an illustration for showing example 3 of the registration screen and the screen transition of a favorite program displayed at the display of the mobile's receiver terminal of FIG. 2.

When the favorite singer button **104*b*3 is pressed on the favorite program selection screen 104*b* (see FIG. 8), the favorite program registration portion 104 displays at the display 112 a favorite singer confirmation screen 104*g* having a registered singer area 104*g*1 showing the name of a currently registered singer (nothing registered in the example of FIG. 10), a registration mode button 104*g*2, and a cancel button 104*g*3 (see FIG. 10). When then the registration mode button 104*g*2 is pressed on the favorite singer confirmation screen 104*g*, the favorite program registration portion 104 displays at the display 112 a favorite singer registration screen 104*h* having a favorite singer registration area 104*h*1, a registration completion button 104*h*2, an additional registration button 104*h*3, and a cancel button 104*h*4 (see FIG. 10). When the name of a favorite singer ("UTADA Hikaru" in the case of FIG. 10) is input to the favorite singer registration area 104*h*1 and then the additional registration button 14*h*3 is pressed, the favorite program registration portion 104 retrieves from the electronic program guide a program in which the singer input in the favorite singer registration area 104*h*1 performs and then stores information of thus retrieved program in the registered favorite program information storage portion 105 utilizing the electronic program guide. It is here to be noted that the favorite singer registration area 104*h*1 may be adapted to display singers so that any one of them can be selected utilizing the electronic program guide. FIG. 10 shows example 3 of the registration screen and the screen transition of a favorite program displayed at the display of the mobile's receiver terminal 1**A.

The registered favorite program information storage portion 105 is described as follows.

The registered favorite program information storage portion 105 is provided with an EEPROM (Electrically Erasable and Programmable Read Only Memory) to store information of a program, a genre, and a singer's program registered by the favorite program registration portion 104. The information of a program to be registered comprises: a program name of any program, if registered, a broadcasting day, broadcast starting time/ending time, a genre, a performer, etc.; a program name of a program corresponding to any genre, if registered, a broadcasting day, broadcast starting time/ending time, a performer, etc.; and a program name of a program in which any singer performs, if registered, a broadcasting day, broadcast starting time/ending time, a genre, etc.

The instantaneous disconnection detection portion 106 is described as follows.

The instantaneous disconnection detection portion 106 detects whether the digital broadcast signal DS can be received normally. Specifically, the instantaneous disconnection detection portion 106 checks for an error in obtained PS data based on the CRC flag of a PES packet of each TS packet of a TS modulated by the digital broadcast reception portion 101 and, if the PES data has an error, decides that the digital broadcast signal cannot be received normally and, otherwise, decides that the digital broadcast signal DS can be received normally.

The favorite program extraction portion 107 is described as follows.

The favorite program extraction portion 107 extracts a favorite program selected by the driver (or fellow passenger) from a TS based on the digital broadcast signal DS. Specifically, the favorite program extraction portion 107 takes out a packet ID number of each TS packet from a TS modulated by the digital broadcast reception portion 101 and also takes out a stream ID of each PES packet. The favorite program extraction portion 107 then searches thus taken out stream ID's for such a stream ID that is stored in the registered favorite program information storage portion 105. When the same stream ID could be retrieved, the favorite program extraction portion 107 extracts all TS packets that have this packet ID number from the TS based on a packet ID number of the TS packet of thus retrieved stream ID. Further, the favorite program extraction portion 107 sequentially links the PES data of the PES packets of these extracted TS packets to thereby sequentially create program content data.

The accumulated program management portion 108 is described as follows.

Each time the favorite program extraction portion 107 extracts program content data, the accumulated program management portion 108 reserves a storage area in an empty region of the favorite program accumulation DB100 to accumulate the program content data and its program information in this storage area. Furthermore, the accumulated program management portion 108 checks the service capacity of the favorite program accumulation DB100 and, if additional storage of this new program content causes overflow of the favorite program accumulation DB100, deletes the accumulated program contents starting from lower priority ones or less recently accumulated ones.

The reproduction/switch-over portion 109 is described as follows.

The reproduction/switch-over portion 109 switches a content to be output audibly according to a reception state of the digital broadcast signal DS. Specifically, if the instantaneous disconnection detection portion 106 decides that the digital broadcast signal DS can be received normally, the reproduction/switch-over portion 109 determines the content of a program acquired by the program content acquisition portion 102 as a content to be output audibly. If the instantaneous disconnection detection portion 106 decides that the digital broadcast signal DS cannot be received normally, the reproduction/switch-over portion 109 takes out the content data of programs from those accumulated in the favorite program accumulation DB100 in a descending order of priority and switches the audible output-subject content data to thus taken out content data. To audibly output the accumulated program content, the reproduction/switchover portion 109 then displays at the display 112 an accumulated-program reproduction/switch-over notification screen 109*a* in order to post the information to the driver etc. (see FIG. 7). FIG. 7 shows the accumulated-program reproduction/switch-over notification screen displayed at the display 112 of the mobile's receiver terminal 1A.

The audio reproduction portion 110 is described as follows.

The audio reproduction portion 110 converts the content data determined by the reproduction/switchover portion 109 to be audibly output into analog data to then reproduce it, thus outputting the program content audibly from the speaker 111.

Figure 4:
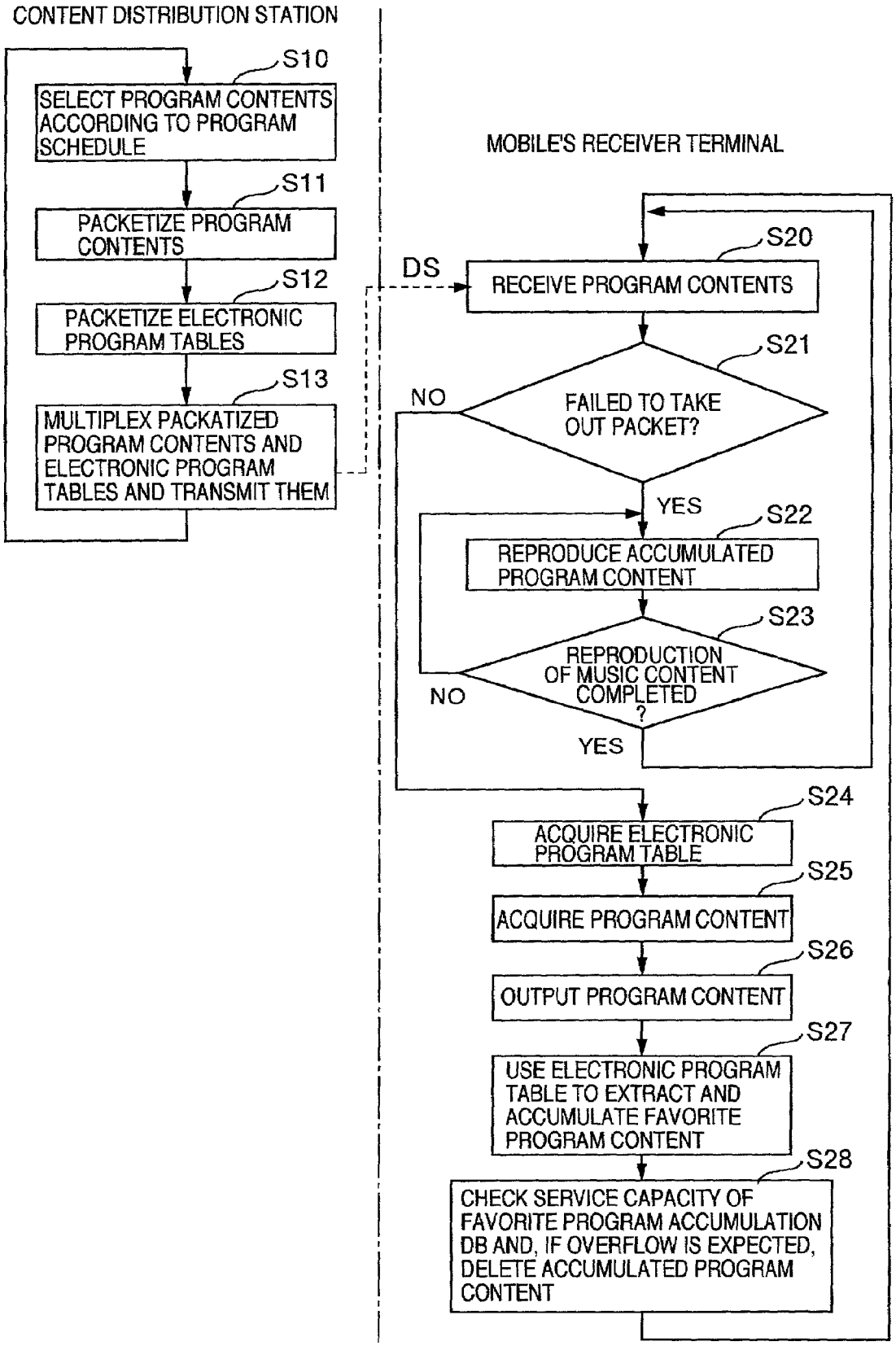
FIG. 4 is a flowchart for showing main processing executed at the mobile's receiver terminal and the content distribution station of FIG. 2.

The following will describe the main processing executed at the mobile's receiver terminal 1A and the content distribution station 2A along a flowchart of FIG. 4 with reference to FIGS. 1, 2, 3, 6, 7, 8, 9, and 10. FIG. 4 shows the flowchart of the main processing executed at the mobile's receiver terminal 1A and the content distribution station 2A.

The content distribution station 2A creates a program schedule and makes a program according to the program schedule. The content distribution station 2A then stores thus made program content data in the content DB200. Moreover, the content distribution station 2A creates an electronic program guide that corresponds to the program schedule and stores the data of this electronic program guide in the electronic program guide DB201.

Then, the content distribution station 2A selects a program content according to the program schedule from the content DB200 (S10) and sub-divides an individual stream of the program content into a plurality of PES packets (S11).

Furthermore, the content distribution station 2A extracts the electronic program guide stored in the electronic program guide DB201 and sub-divide an individual stream of the electronic program guide into a plurality of PES packets.

Subsequently, the content distribution station 2A multiplexes the PES packets of these many contents and those of the electronic program guide to thereby create a TS, modulates this TS into a digital broadcast signal DS that fits satellite broadcasting or ground-wave broadcasting, and then transmits this digital broadcast signal DS through the transmission antenna to the artificial satellite AS or the radio wave tower RT (S13). Upon completion of processing at S13, the content distribution station 2A returns to S10 to repeat the above-mentioned processing.

The mobile's receiver terminal 1A, on the other hand, receives the digital broadcast signal DS carrying those many contents transmitted from the artificial satellite AS or the radio wave tower RT (S20).

The mobile's receiver terminal 1A converts the digital broadcast signal DS into the TS and then decides whether it failed to take out any PES packet based on its CRC flag contained in each TS packet (S21).

If having decided at S21 that it failed to take out a PES packet, the mobile's receiver terminal 1A decides that the digital broadcast signal DS cannot be received normally and then takes out the data of programs contents of those accumulated in the favorite program accumulation DB100 in an descending order of priority. The mobile's receiver terminal 1A then converts thus taken out content data into analog data and reproduces this analog data of the program contents to output it audibly from the speaker 111 (S22). At the same time, the mobile's receiver terminal 1A displays at the display 112 the instantaneous disconnection occurrence and the accumulated-program reproduction/switch-over notification screen 109*a* (see FIG. 7).

Then, the mobile's receiver terminal 1A decides whether audible output of the content of the program reproduced at S22 is already ended (S23) and, if it is not ended yet, continues processing of S22 until it ends and, otherwise, returns to the processing of S20.

If having decided at S21 that it did not fail to take any PES packet, on the other hand, the mobile's receiver terminal 1A decides that the digital broadcast signal DS can be received normally. Then, the mobile's receiver terminal 1A acquires the electronic program guide from the TS based on the digital broadcast signal DS (S24).

Further, the mobile's receiver terminal 1A acquires the content data of a program (channel) currently selected by the driver (or fellow passenger) from the TS based on the digital broadcast signal DS (S25), converts thus acquired program content data into analog data, and then reproduce this analog data of program content, thus audibly outputting it from the speaker 111 (S26).

Furthermore, the mobile's receiver terminal 1A searches the TS based on the digital broadcast signal for a program stored in the registered favorite program information storage portion 105 and, if any, extracts content data of this program from the TS and accumulates thus extracted content data and its program information in the favorite program accumulation DB100 (S27). Further, the mobile's receiver terminal 1A checks the service capacity of the favorite program accumulation DB100 and, if overflow is expected to occur, deletes the contents data of programs and the program information in an ascending order of priority from the favorite program accumulation DB100 (S28). Upon completion of processing at S28, the mobile's receiver terminal 1A returns to S20 to repeat the processing.

Figure 5:
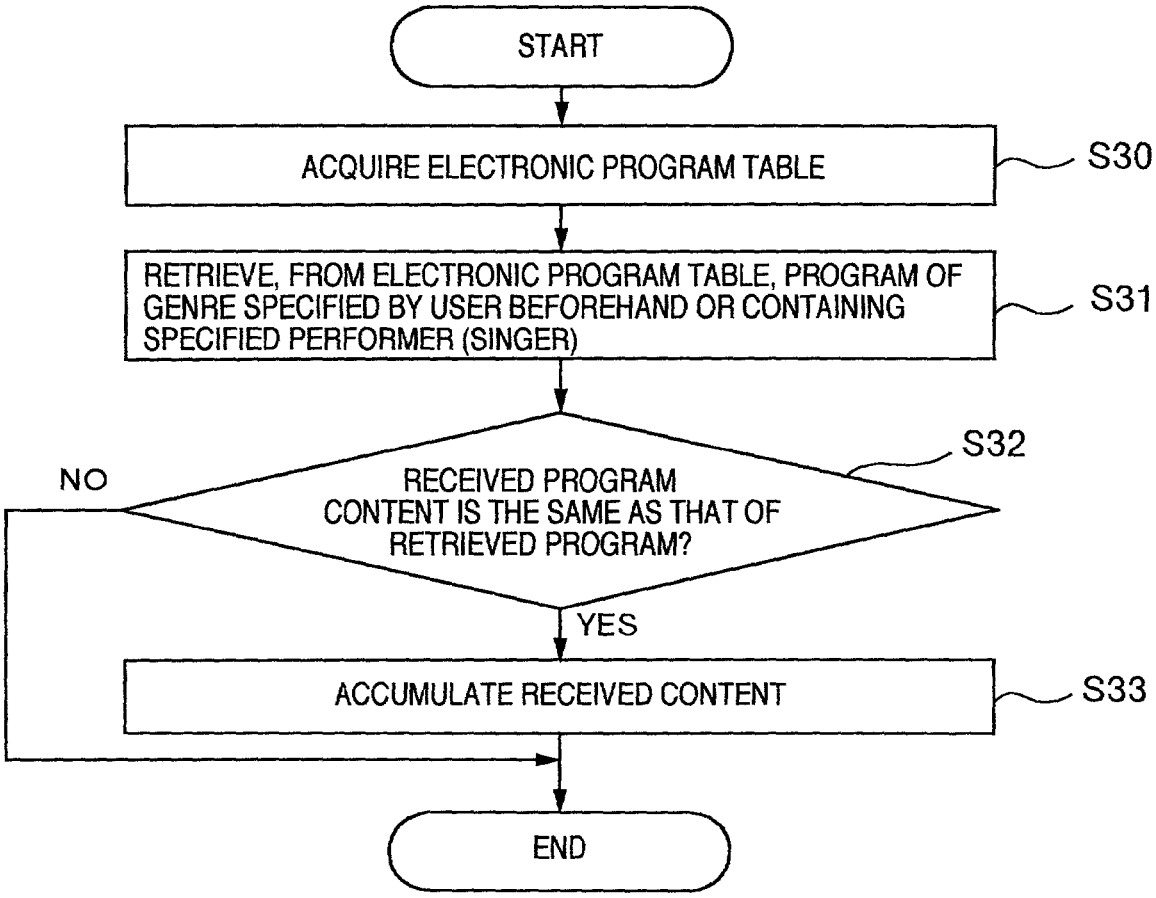
FIG. 5 is a flowchart for showing favorite program extracting processing executed at the mobile's receiver terminal of FIG. 2.

The following will describe favorite program extraction processing executed by the mobile's receiver terminal 1A along a flowchart of FIG. 5 with reference to FIGS. 1, 2, 3, 6, 7, 8, 9, and 10. FIG. 5 shows the flowchart of favorite program extracting processing executed at the mobile's receiver terminal 1A.

The mobile's receiver terminal 1A registers a favorite program, genre, or singer of the driver (or fellow passenger) so that he can accumulate his favorite program contents and dies it also store the information in the registered favorite program information storage portion 105.

The mobile's receiver terminal 1A acquires the electronic program guide from a TS based on the digital broadcast signal like in the case of the above-mentioned processing at S24 (S30). If the driver (or fellow passenger) has registered his favorite genre or singer beforehand, the mobile's receiver terminal 1A searches the electronic program guide for a program which corresponds to the genre or in which the singer performs (S31) and then stores its information in the registered favorite program information storage portion 105.

Further, based on the information stored in the registered favorite program information storage portion 105, the mobile's receiver terminal 1A decides whether there is a program that corresponds to the genre or singer registered by the driver (or fellow passenger) (S32). If it decides at S32 that there is no such program, it ends the favorite program extraction processing. If it decides there is such a program at S32, on the other hand, the mobile's receiver terminal 1A extracts content data of the corresponding program from the TS and then accumulates thus extracted program content data and the program information in the favorite program accumulation DB100 (S33).

This mobile's receiver terminal 1A can audibly output contents of a favorite program accumulated beforehand to thereby avoid interruption of the audible output even when an automobile carrying it travels into a tunnel or a building's shadow and cannot receive the digital broadcast signal DS normally. Moreover, this mobile's receiver terminal 1A permits the driver (or fellow passenger) to register his favorite program, genre, or singer so that contents of the corresponding program can be accumulated and reproduced on the basis of this registered information.

Second Embodiment

The following will describe the second embodiment.

Figure 11:
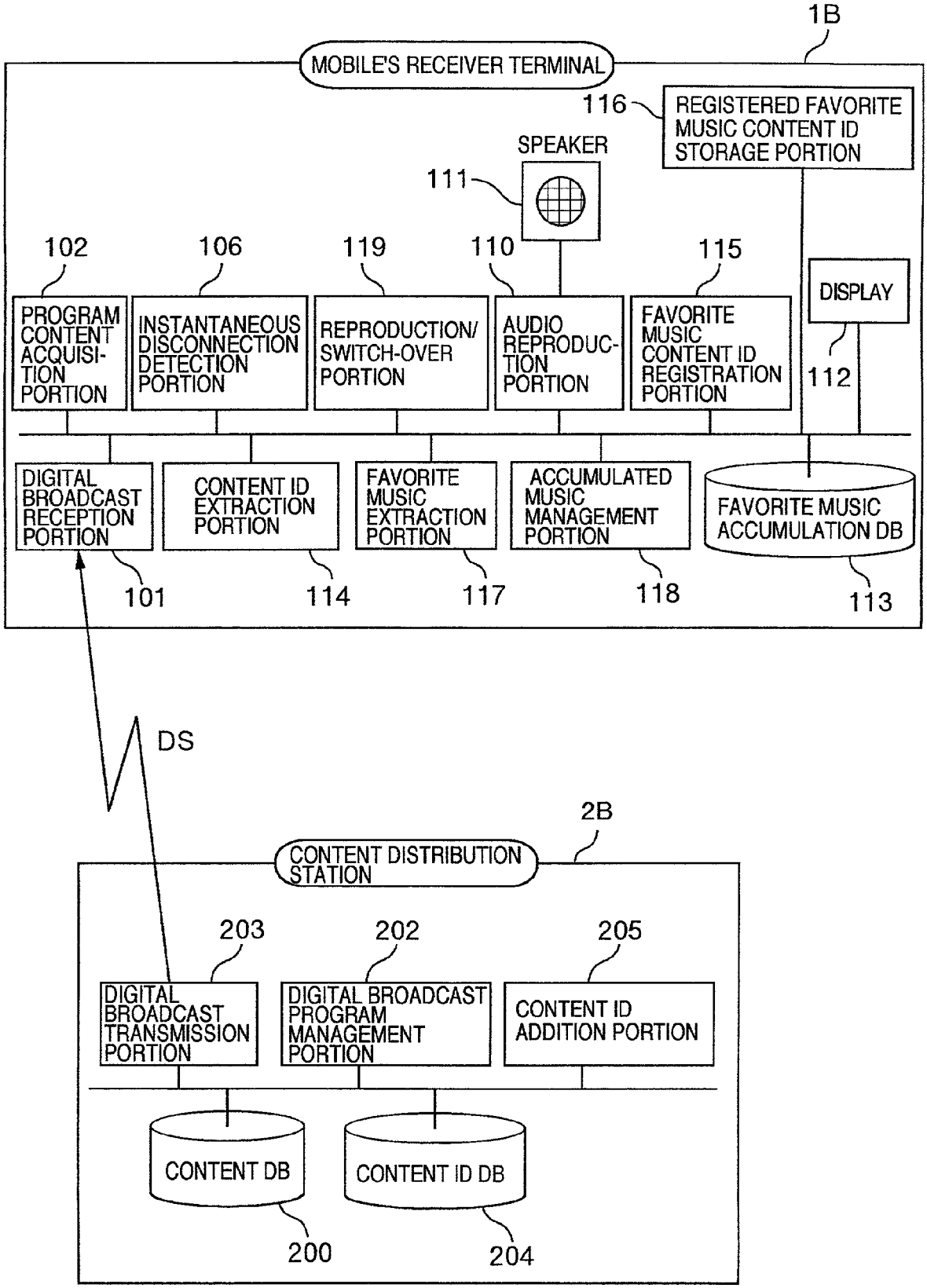
FIG. 11 is an internal configuration diagram for showing the mobile's receiver terminal and the content distribution station related to a second embodiment.

First, the internal configuration of a content distribution station 2B is described with reference to FIG. 11. It is here to be noted that the same components of the content distribution station 2B as those of the content distribution station 2A of the first embodiment are indicated by the same reference symbols and their description is omitted. FIG. 11 shows an internal configuration diagram of the mobile's receiver terminal 1B and the content distribution station 2B related to the second embodiment.

Figure 15:
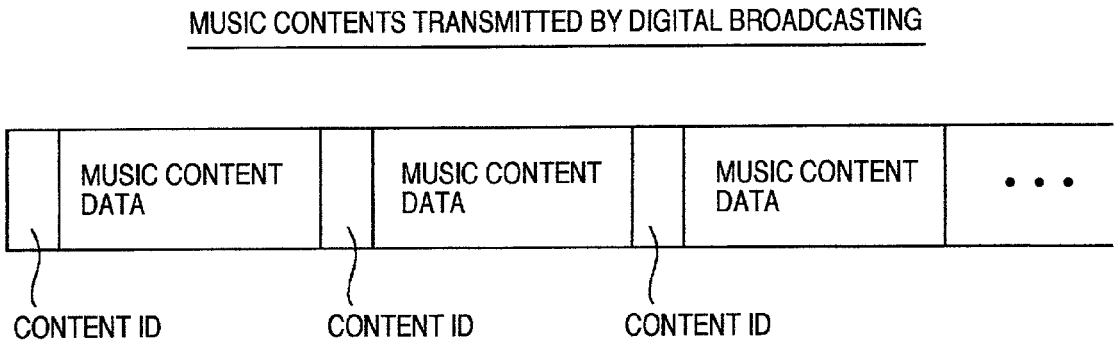
FIG. 15 is a configuration diagram for showing a music content broadcast digitally.

The content distribution station 2B mainly comprises the content DB200, a content IDDB204, a content ID addition portion 205, the digital broadcast program management portion 202, and the digital broadcast transmission portion 203. As such, the content distribution station 2B is provided with a distribution server, a variety of circuits, a memory, a transmission antenna, etc., which are not shown. Although not described, a music content performed in a program is taken into account in the second embodiment. A music content distributed by digital broadcasting has a content ID as well as music content data as shown in FIG. 15 and can be identified by this content ID. The content ID is given to uniquely identify each music content. FIG. 15 shows a configuration diagram of a music content distributed by digital broadcasting.

The content IDDB204 is described as follows.

The content IDDB204 is constituted in a hard disk device etc., storing information related to the content ID's assigned to music contents. The information may contain a content ID, a melody name, a singer name or group name, a performance time, a program in which the music content is performed, etc.

The content ID addition portion 205 is described as follows.

The content ID addition portion 205 adds a content ID assigned for each music content performed in a program content to the content data of the music content.

It is here to be noted that the content DB200, which is the same as that according to the first embodiment though, contains also a music content as a program content and so has the information of the music content in the information of programs it stores. Furthermore, if the analog data of a music content is compressively coded, the content ID is contained in its individual stream and so stores in the PES data of a PES packet of a TS.

The following will describe the internal configuration of the mobile's receiver terminal 1B with reference to FIG. 11. It is here to be noted that the same components of the mobile's receiver terminal 1B as those of the mobile's receiver terminal 1A according to the first embodiment are indicated by the same reference symbols and their description is omitted.

The mobile's receiver terminal 1B mainly comprises a favorite program accumulation DB113, the digital program reception portion 101, the program content acquisition portion 102, a content ID extraction portion 114, a favorite music content ID registration portion 115, a registered favorite music content ID storage portion 116, the instantaneous disconnection detection portion 106, a favorite music extraction portion 117, an accumulated music management portion 118, a reproduction/switch-over portion 119, and the audio reproduction portion 110. As such, the mobile's receiver terminal 1B is equipped with an MPU (Micro Processing Unit), a RAM (Random Access Memory), a variety of circuits, a memory, a reception antenna, a user interface (operation portion), the speaker 111, the display 112, etc., which are not shown.

According to the second embodiment, the favorite music accumulation DB113 corresponds to the claimed content accumulation means, the instantaneous disconnection detection portion 106 corresponds to the claimed reception state detection means, the reproduction/switch-over portion 119 corresponds to the claimed switch-over means, the content ID extraction portion 114 corresponds to the claimed content ID acquisition means, the favorite music content ID registration portion 115 corresponds to the claimed content ID registration means, the registered favorite music content ID storage portion 116 corresponds to the claimed content ID storage means, and the favorite music extraction portion 117 and the accumulated music management portion 118 correspond to the claimed content extraction means.

The favorite music accumulation DB113 is described as follows.

The favorite music accumulation DB113 is constituted in a hard disk device etc., for storing the content data of a favorite music content selected by the driver (or fellow passenger) and the content information. Specifically, as shown in FIG. 12, it stores a content ID, a melody name, a singer name or group name, a performance time, an accumulation day, an accumulation time, and content data. FIG. 12 shows a data configuration diagram of the favorite music accumulation DB113 of the mobile's receiver terminal 1B.

The content ID extraction portion 114 is described as follows.

The content ID extraction portion 114 takes out each PES packet from a TS modulated by the digital broadcast reception portion 101 to then extract a content ID of a music content from the PES data of each PES packet thus taken out.

The favorite music content ID registration portion 115 is described as follows.

Figure 17:
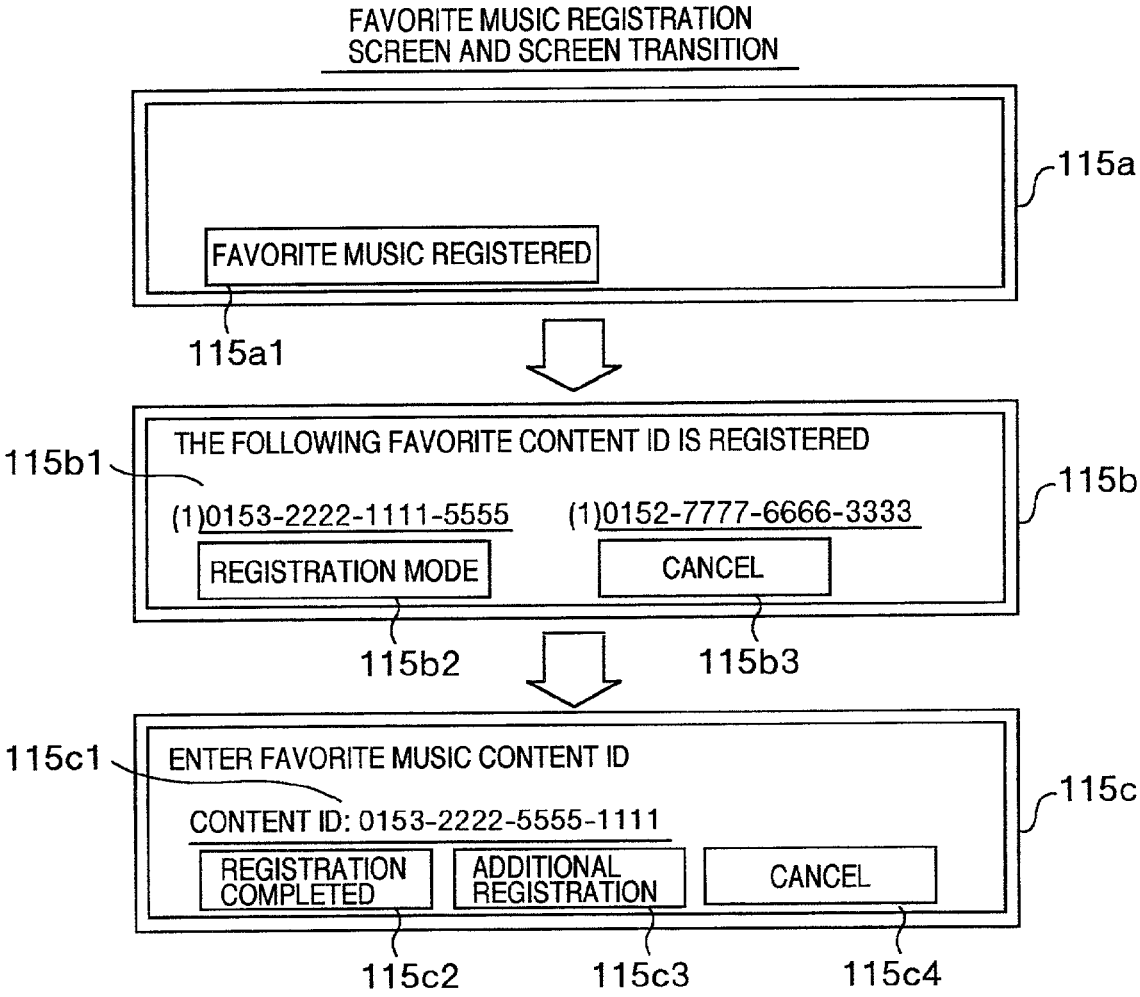
FIG. 17 is an illustration for showing of a registration screen and a screen transition of favorite music displayed at the display of the mobile's receiver terminal of FIG. 11.

The favorite music content ID registration portion 115 is provided with the above-mentioned user interface (operation portion) and the display 112 so that the driver (or fellow passenger) can register the content ID of his favorite music content. When a favorite music registration button (not shown) of the user interface is pressed, the favorite music content ID registration portion 115 displays at the display 112 a favorite music registration initial screen 115*a* having a favorite music registration button 115*a*1 (see FIG. 17). When the favorite music registration button 115*a*1 is pressed on the favorite program registration initial screen 115*a* is pressed, the favorite music registration portion 115 displays at the display 112 a favorite music confirmation screen 115*b* having a registered content ID area 115*b*1 indicating a content ID ((1) 0153-2222-1111-5555 etc. in the example of FIG. 17) of a currently registered favorite music content, a registration mode button 115*b*2, and a cancel button 115*b*3 (see FIG. 17). When the registration mode button 115*b*2 is pressed on the favorite music confirmation screen 115*b*, the favorite music content ID registration portion 115 displays at the display 112 a favorite music registration screen 115*c* having a favorite music content ID registration area 115*c*1, a registration completion button 115*c*2, an additional registration button 115*c*3, and a cancel button 115*c*4 (see FIG. 17). When a content ID (0152-2222-5555-1111 in the example of FIG. 17) of a favorite content is input into the favorite music content ID registration area 115*c*1 and the additional registration button 115*c*3 is pressed, the favorite music content ID registration portion 115 stores the content ID input in the favorite music content ID registration area 115*c*1 in the registered favorite music content ID information storage portion 116. It is here to be noted that the registered favorite music content ID information storage portion 116 may store not only a content ID but also a melody name, a singer name or group name, etc. of a music content that corresponds to this content ID. FIG. 17 shows an example of the favorite music registration screen and the screen transition displayed at the display 112 of the mobile's receiver terminal 1B.

The registered favorite music content ID storage portion 116 is described as follows.

The registered favorite music content ID storage portion 116 is provided with an EEPROM (Electrically Erasable and Programmable Read Only Memory) to store a content ID registered by the favorite music content ID registration portion 115. As mentioned above, besides a content ID, a melody name, a singer name or groups name, etc. may be stored.

The favorite music extraction portion 117 is described as follows.

The favorite music extraction portion 117 extracts a music content of a content ID selected by the driver (or fellow passenger) from a TS based on the digital broadcast signal DS. Specifically, the favorite music extraction portion 117 searches the content ID's extracted by the content ID extraction portion 114 for such a content ID that is stored in the registered favorite music content ID storage portion 116. When the same content ID could be retrieved, the favorite music extraction portion 117 extracts all TS packets having this packet ID from the TS based on the packet ID of a TS packet of the retrieved content ID. Further, the favorite music extraction portion 117 sequentially links the PES data of the PES packets of thus extracted TS packets to thereby sequentially create music content data.

The accumulated music management portion 118 is described as follows.

Each time the favorite music extraction portion extracts music content data, the accumulated music management portion 118 reserves a storage area in an empty region of the favorite music accumulation DB113 to thereby accumulate information of the music content data and its music content in this storage area. Furthermore, the accumulated music management portion 118 checks the service capacity of the favorite music accumulation DB113 and, if storage of the new music content causes overflow of the favorite music accumulation DB113, deletes the accumulated music contents starting from less recently accumulated ones.

The reproduction/switch-over portion 119 is described as follows.

Figure 16:
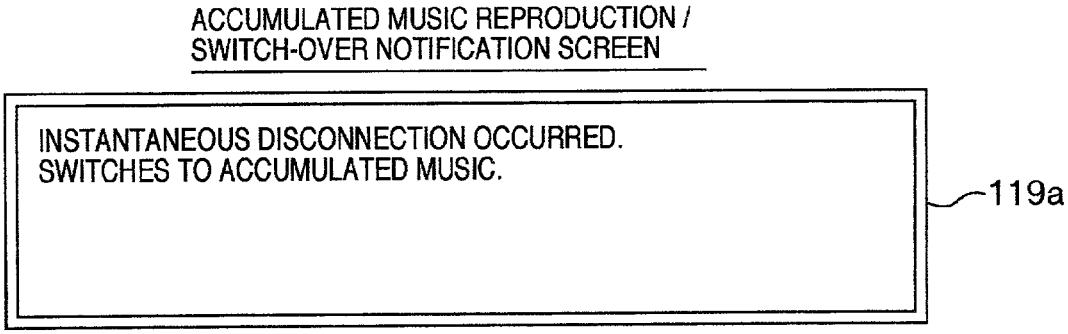
FIG. 16 is an illustration for showing a screen for posting reproduction/switch-over to an accumulated music piece displayed at the display of the mobile's receiver terminal of FIG. 11.

The reproduction/switch-over portion 119 switches a content to be output audibly according to a reception state of the digital broadcast signal DS. Specifically, if the instantaneous disconnection detection portion 106 decides that the digital broadcast signal DS can be received normally, the reproduction/switch-over portion 119 determines the content of a program acquired by the program content acquisition portion 102 as a content to be output audibly. If the instantaneous disconnection detection portion 106 decides that the digital broadcast signal DS cannot be received normally, the reproduction/switch-over portion 119 takes out the music content data accumulated in the favorite music accumulation DB113 starting from more recently accumulated data and switches the audible output-subject content data to thus taken out content data. To audibly output the accumulated music content, the reproduction/switch-over portion 119 then displays at the display 112 an accumulated-music reproduction/switch-over notification screen 119*a* in order to post the information to the driver etc. (see FIG. 16). FIG. 16 shows the accumulated-music reproduction/switch-over notification screen displayed at the display 112 of the mobile's receiver terminal 1B.

Figure 13:
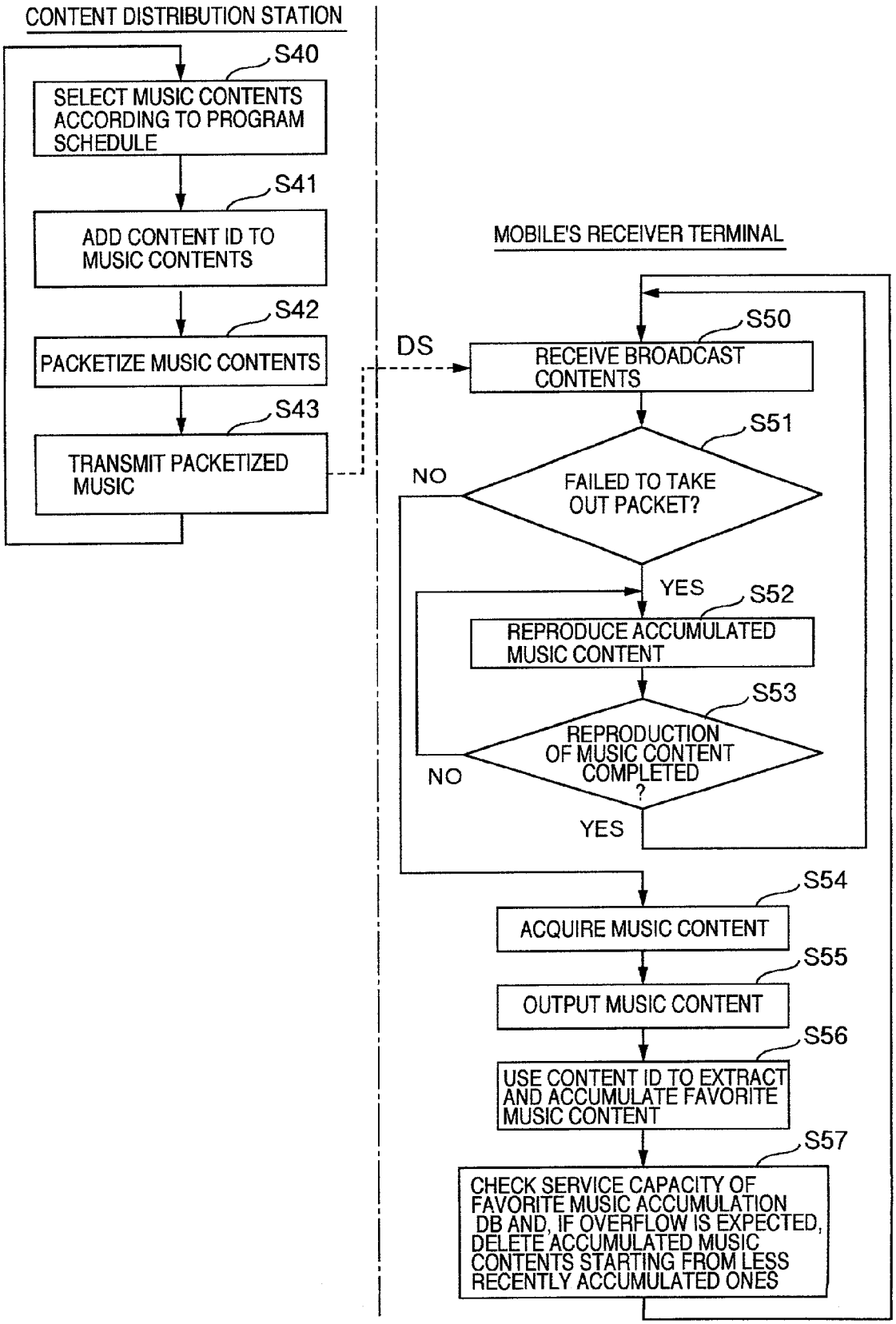
FIG. 13 is a flowchart for showing the main processing executed at the mobile's receiver terminal and the content distribution station of FIG. 11.

The following will describe the main processing executed at the mobile's receiver terminal 1B and the content distribution station 2B along a flowchart of FIG. 13 with reference to FIGS. 1, 11, 12, 15, 16, and 17. FIG. 13 shows the flowchart of the main processing executed at the mobile's receiver terminal 1B and the content distribution station 2B.

The content distribution station 2B creates a program schedule and makes a program according to the program schedule. The content distribution station 2B then stores thus made program content data (including music content data) in the content DB200.

Then, the content distribution station 2B selects a music content to be performed according to the program schedule from the content DB200 (S40).

Subsequently, the content distribution station 2B adds a content ID to thus selected music content (S41).

Further, the content distribution station 2B sub-divides an individual stream of the music content into a plurality of PES packets (S42).

Subsequently, the content distribution station 2B multiplexes the PES packets of these many contents and those of the electronic program guide to thereby create a TS, modulates this TS into a digital broadcast signal DS that fits satellite broadcasting or ground-wave broadcasting, and then transmits this digital broadcast signal DS through the transmission antenna to the artificial satellite AS or the radio wave tower RT (S43). Upon completion of processing at S43, the content distribution station 2B returns to S40 to repeat the above-mentioned processing.

The mobile's receiver terminal 1B, on the other hand, receives the digital broadcast signal DS carrying those many contents transmitted from the artificial satellite AS or the radio wave tower RT (S50).

Then, the mobile's receiver terminal 1B converts the digital broadcast signal DS into the TS and then decides whether it failed to take out any PES packet based on its CRC flag contained in each TS packet (S51).

If having decided at S21 that it failed to take out a PES packet, the mobile's receiver terminal 1B decides that the digital broadcast signal DS can be received normally and then takes out the data of music contents of those accumulated in the favorite music accumulation DB113 starting from more recently accumulated ones. The mobile's receiver terminal 1B then converts thus taken out content data into analog data and reproduces the music content of this analog data to output it audibly from the speaker 111 (S52). At the same time, the mobile's receiver terminal 1B displays at the display 112 the instantaneous disconnection occurrence and the accumulated-music reproduction/switch-over notification screen 119*a* (see FIG. 16).

Then, the mobile's receiver terminal 1B decides whether audible output of the content of the music content reproduced at S52 is already ended (S53) and, if it is not ended yet, continues processing of S52 until it ends and, otherwise, returns to the processing of S50.

If having decided at S51 that it did not fail to take any PES packet, on the other hand, the mobile's receiver terminal 1B decides that the digital broadcast signal DS can be received normally. Then, the mobile's receiver terminal 1B acquires the content data (hence music content data) of a program currently selected by the driver (or fellow passenger) from the TS based on the digital broadcast signal DS (S54), converts thus acquired program content data (hence music content data) into analog data, and then reproduces this analog data of the program content (music content), thus audibly outputting it from the speaker 111 (S55).

Furthermore, mobile's receiver terminal 1B searches the TS based on the digital broadcast signal DS for a content ID stored in the registered favorite music content ID storage portion 116 and, if such a content is retrieved, extracts the content data of a music content having this content ID from the TS and accumulates the information of thus extracted content data and the corresponding music content in the favorite music accumulation DB113 (S56). Further, the mobile's receiver terminal 1B checks the service capacity of the favorite music accumulation DB113 and, if overflow is expected to occur, deletes from the favorite music accumulation DB113 the information of the music content data and the corresponding music contents starting from the less recently accumulated information (S57). When the processing at S57 is completed, the mobile's receiver terminal 1B then returns to S50 to repeat the above-mentioned processing.

Figure 14:
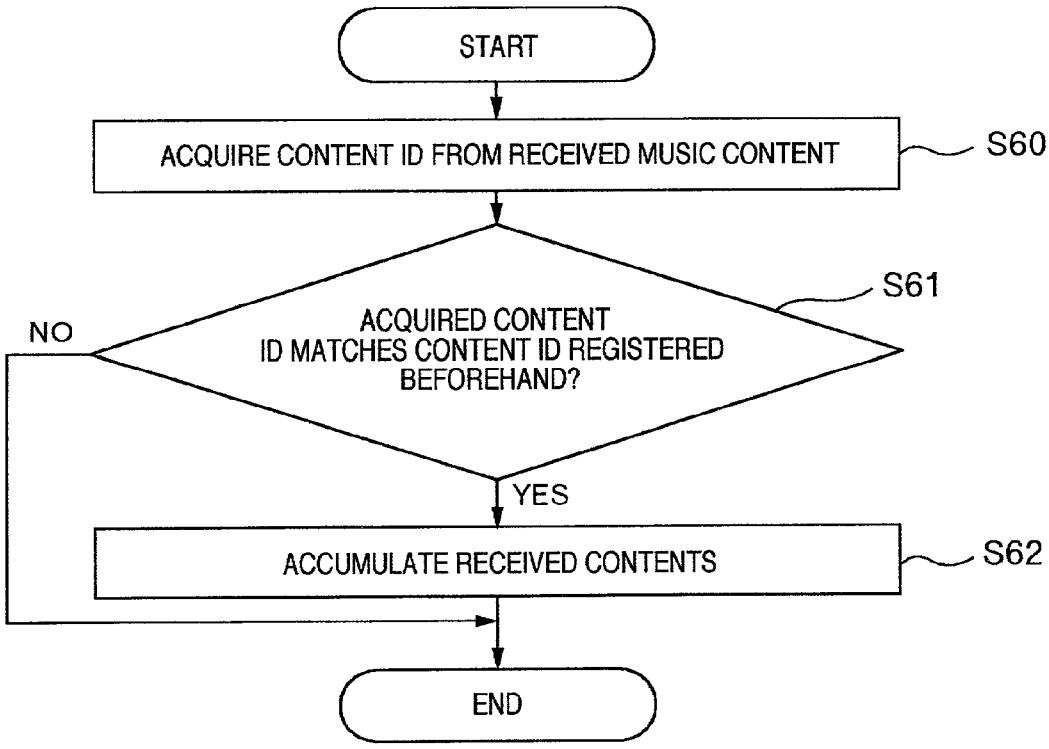
FIG. 14 is a flowchart for favorite music extracting processing executed at the mobile's receiver terminal of FIG. 11.

The following will describe favorite music extraction processing executed by the mobile's receiver terminal 1B along a flowchart of FIG. 14 with reference to FIGS. 1, 11, 12, 15, 16, and 17. FIG. 14 shows the flowchart of favorite music extracting processing executed at the mobile's receiver terminal 1B.

The mobile's receiver terminal 1B registers a content ID of a driver's (or fellow passenger's) favorite music content he accumulates and also stores its information in the registered favorite music content ID storage portion 116. First, the mobile's receiver terminal 1B acquires a content ID of a music content from the TS based on the digital broadcast signal DS (S60).

Then, based on the content ID stored in the registered favorite music content ID storage portion 116, the mobile's receiver terminal 1B decides whether there is a content ID registered by the driver (or fellow passenger) among the content ID's acquired at S60 (S61). If having decided at S61 that there is no such content ID, it ends the favorite music extraction processing. If having decided at S61 that there is such a content ID, on the other hand, the mobile's receiver terminal 1B extracts content data of the corresponding music content and accumulates the content data of thus extracted music content and its information in the favorite music accumulation DB113 (S62).

By this mobile's receiver terminal 1B, even if the automobile cannot receive the digital broadcast signal DS normally when it has entered a tunnel or a building shade, the favorite music contents accumulated beforehand can be output audibly, thus avoiding interruption of audible output. Furthermore, by this mobile's receiver terminal 1B, the driver (or fellow passenger) can register a content ID of his favorite music content to thereby accumulate and reproduce music contents based on thus registered content ID.

Third Embodiment

The following will describe a third embodiment.

It is here to be noted that the internal configuration of a content distribution station 2C is the same as that of the content distribution station 2B of the second embodiment and its description is omitted.

Figure 18:
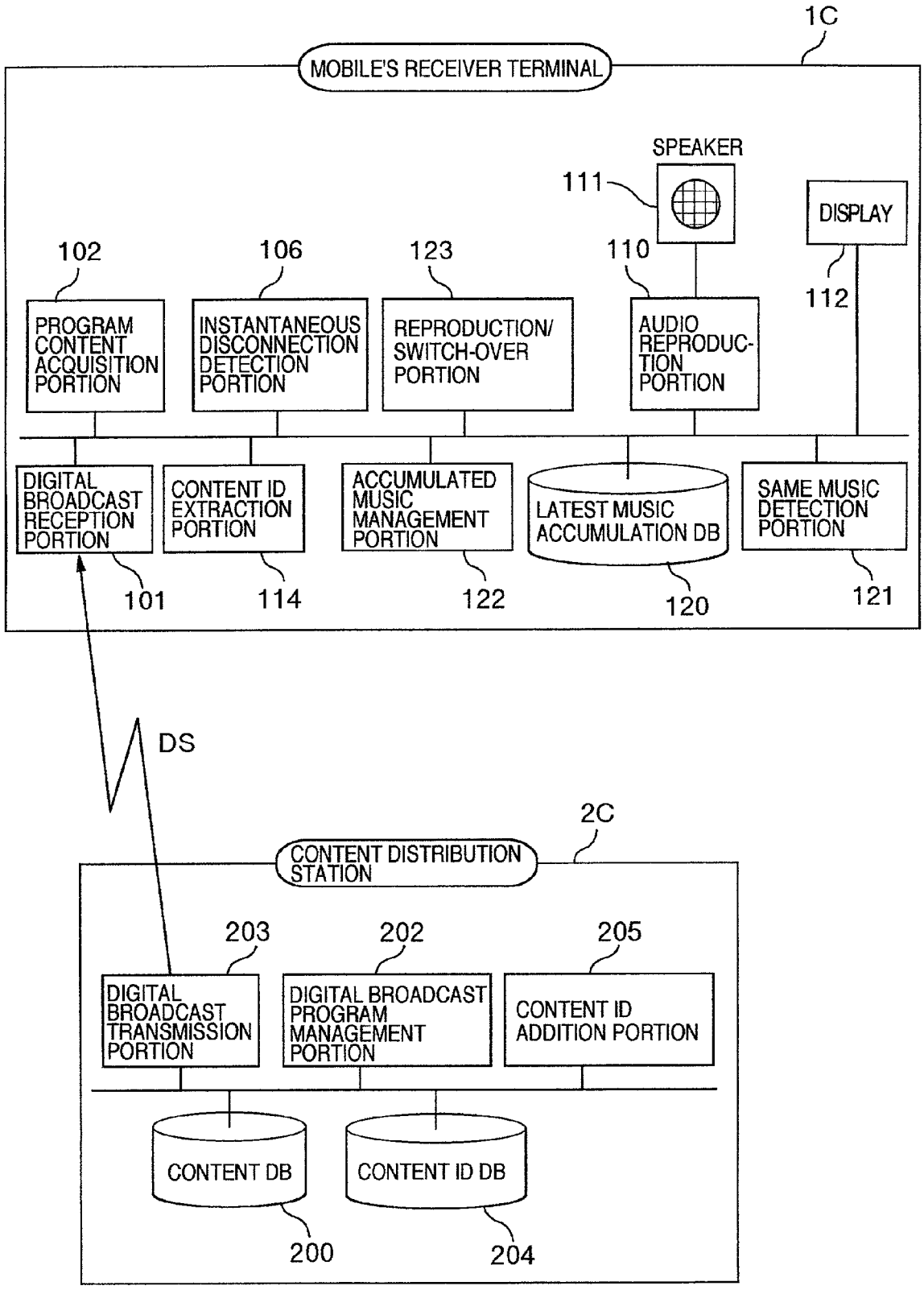
FIG. 18 is an internal configuration diagram for showing the mobile's receiver terminal and the content distribution station related to a third embodiment.

The following will describe the internal configuration of a mobile's receiver terminal 1C with reference to FIG. 18. It is here to be noted that the same components of the mobile's receiver terminal 1C as those of the mobile's receiver terminal 1B of the second embodiment are indicated by the same reference symbols and their description is omitted. FIG. 18 shows the internal configuration of the mobile's receiver terminal 1C and the content distribution station 2C related to the third embodiment.

The mobile's receiver terminal 1C mainly comprises a latest music accumulation DB120, the digital broadcast reception portion 101, the program content acquisition portion 102, the content ID extraction portion 114, the instantaneous disconnection detection portion 106, a same music detection portion 121, an accumulated music management portion 122, a reproduction/switch-over portion 123, and an audio reproduction portion 110. As such, the mobile's receiver terminal 1C is equipped with an MPU, a RAM, a variety of circuits, a memory, a reception antenna, a user interface (operation portion), the speaker 111, the display 112, etc., which are not shown.

In the third embodiment, the latest music accumulation DB120 corresponds to the claimed content accumulation means, the instantaneous disconnection detection portion 106 corresponds the claimed reception state detection means, the same music detection portion 121 corresponds to the claimed same content detection means, and the reproduction/switch-over portion 123 corresponds to the claimed switch-over means.

The latest music accumulation DB120 is described as follows.

The latest music accumulation DB120 is constituted in a hard disk device etc., for storing the content data of a latest music content selected by the driver (or fellow passenger) and the content information. Specifically, as shown in FIG. 19, it stores an accumulation day, an accumulation time, a content ID, a melody name, a singer name or group name, a performance time, and content data. FIG. 19 shows a data configuration diagram of the latest music accumulation DB120 of the mobile's receiver terminal 1C.

The same music detection portion 121 is described as follows.

When the digital broadcast signal DS cannot be received normally, the same music detection portion 121 detects the same music content as that currently output audibly from the speaker 111 in order to avoid interruption of the audible output. Specifically, the same music detection portion 121 retrieves the same content ID as that of a music content (which is being performed in a program acquired by the program content acquisition portion 102) currently output audibly from the speaker 111 from among the content ID's stored in the latest music accumulation DB120. If the same content ID could be found, the same music detection portion 121 extracts the content data corresponding to that content ID from the latest music accumulation DB120.

The accumulated music management portion 122 is described as follows.

Upon reception of the digital broadcast signal DS, the accumulated music management portion 122 accumulates the latest music content. Specifically, the accumulated music management portion 122 takes out each PES packet from a TS modulated by the digital broadcast reception portion 101 to thereby extract a content ID and content data of a music content from the PES data of the PES packet. Each time it extracts the music content data, the accumulated music management portion 122 reserves a storage area in an empty region of the latest music accumulation DB120 to thereby accumulate information of the music content data and its music content in this storage area. Moreover, the accumulated music management portion 122 checks the service capacity of the latest music accumulation DB120 and, if storage of the new music content causes overflow of the latest music accumulation DB120, deletes the accumulated music contents starting from less recently accumulated ones.

The reproduction/switch-over portion 123 is described as follows.

The reproduction/switch-over portion 123 switches a content to be output audibly according to a reception state of the digital broadcast signal DS and an accumulation state of music contents. Specifically, if the instantaneous disconnection detection portion 106 decides that the digital broadcast signal DS can be received normally, the reproduction/switch-over portion 123 determines the content (hence music content) of a program acquired by the program content acquisition portion 102 as a content to be output audibly.

Figure 21:
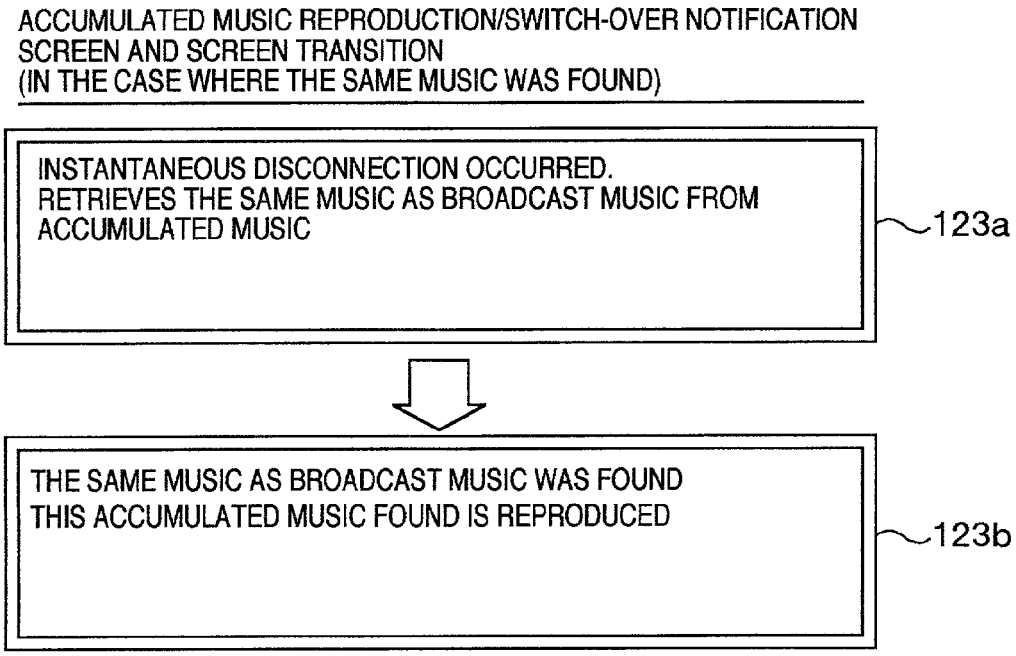
FIG. 21 is an illustration for showing the screen for posting reproduction/switch-over and the screen transition (in the case where the same music was found) to accumulated music displayed at the display of the mobile's receiver terminal of FIG. 18.

If the instantaneous disconnection detection portion 106 decides that the digital broadcast signal DS cannot be received normally, the reproduction/switch-over portion 123 switches the audible output-subject content to such music content data that was retrieved and extracted by the same music detection portion 121. If the same music content as that audibly output currently can be output audibly, it notifies the driver etc. of that information by displaying at the display 112 a screen 123*a* indicating the retrieval of the same music as that being broadcast from the accumulated music then a screen 123*b* indicating the reproduction of the same music (see FIG. 21). FIG. 21 shows the accumulated music reproduction/switch-over notification screen and the screen transition (in the case where the same music was found) displayed at the display 112 of the mobile's receiver terminal 1C.

Figure 22:
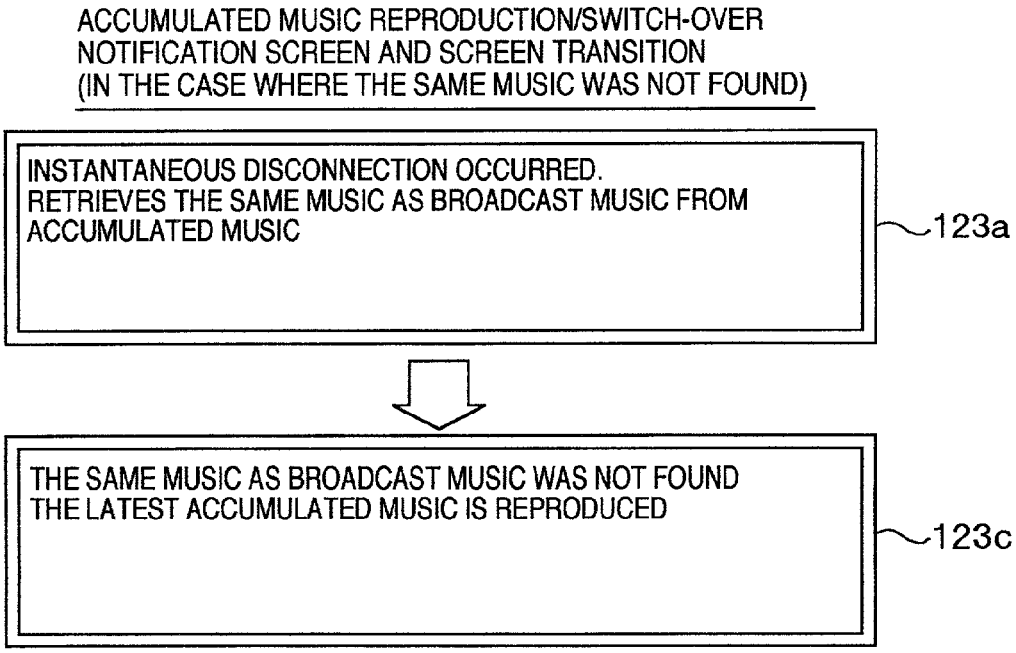
FIG. 22 is an illustration for showing the screen for posting reproduction/switch-over and the screen transition (in the case where the same music was not found) to accumulated music displayed at the display of the mobile's receiver terminal of FIG. 18.

If the same music detection portion 121 cannot retrieve the same content ID, however, the reproduction/switch-over portion 123 takes out the music content data of the music contents accumulated in the latest music accumulation DB120 starting from more recently accumulated data and switches the audible output-subject content data to thus taken out content data. To audibly output the latest music content, the reproduction/switch-over portion 123 then notifies the driver etc. of that information by displaying at the display 112 the screen 123*a* indicating the retrieval of the same music as that being broadcast from the accumulated music then a screen 123*c* indicating the reproduction of the latest music (see FIG. 22). FIG. 22 shows the accumulated music reproduction/switch-over notification screen and the screen transition (in the case where the same music was not found) displayed at the display 112 of the mobile's receiver terminal 1C.

Figure 20:
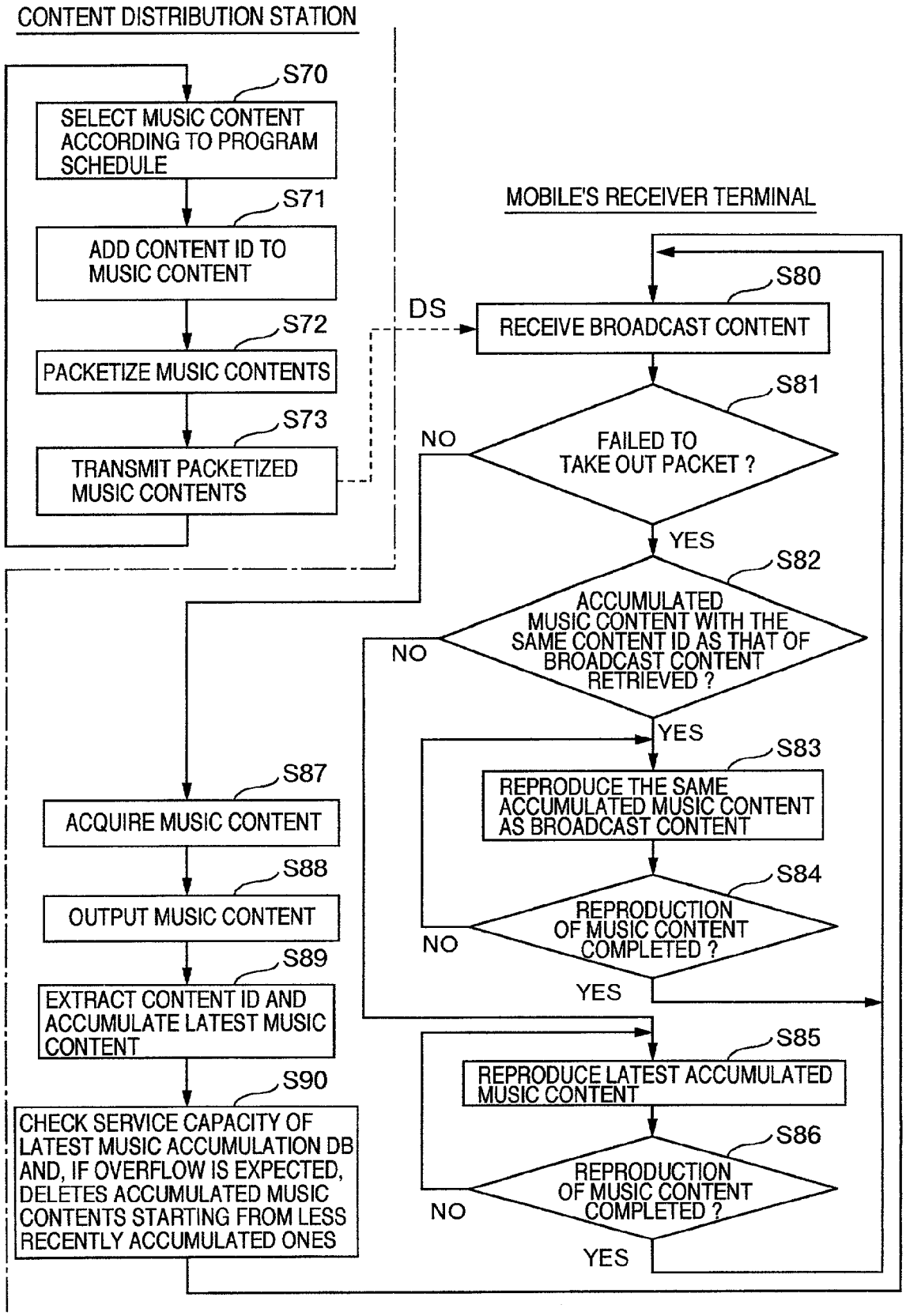
FIG. 20 is a flowchart for showing the main processing executed at the mobile's receiver terminal and the content distribution station of FIG. 18.

The following will describe the main processing executed at the mobile's receiver terminal 1C and the content distribution station 2C along a flowchart of FIG. 20 with reference to FIGS. 1, 18, 19, 21, and 22. FIG. 20 shows the flowchart of the main processing executed at the mobile's receiver terminal 1C and the content distribution station 2C.

The main processing (S70–S73) executed at the content distribution station 2C is the same as that (S40–S43) executed at the content distribution station 2B of the second embodiment and so its description is omitted here.

The mobile's receiver terminal 1C, on the other hand, receives the digital broadcast signal DS carrying many contents transmitted from the artificial satellite AS or the radio wave tower RT (S80).

The mobile's receiver terminal 1C converts the digital broadcast signal DS into the TS and then decides whether it failed to take out any PES packet based on its CRC flag contained in each TS packet (S81).

If having decided that it failed to take out a PES packet at S81, the mobile's receiver terminal 1C decides that the digital broadcast signal DS cannot be received normally and then retrieves a music content of the same content ID as that of a music content audibly output currently according to the currently received digital broadcast signal DS from among those music contents accumulated in the latest music accumulation DB120 (S82). At the same time, the mobile's receiver terminal 1C displays at the display 112 the instantaneous disconnection occurrence and the same music retrieval notification screen 123*a* (see FIGS. 21 and 22).

If the music content having the same content ID could be retrieved at S82, the mobile's receiver terminal 1C converts the content data of thus retrieved music content into analog data and then reproduce its music content, thus audibly outputting it from the speaker 111 (S83). At the same time, the mobile's receiver terminal 1C displays at the display 112 the accumulated-same-music reproduction/switch-over notification screen 123*b* (see FIG. 21). Then, the mobile's receiver terminal 1C decides whether audible output of the music content reproduced at S83 is already ended (S84) and, if it is not ended yet, continues processing of S83 until it ends and, otherwise, returns to the processing of S80.

If the music content having the same content ID could not be retrieved at S82, on the other hand, the mobile's receiver terminal 1C takes out content data of the music contents from the latest music accumulation DB120 starting from the more recently accumulated data, converts thus taken out content data into analog data, and then reproduce the music content of that analog data, thus audibly outputting it from the speaker 111 (S85). At the same time, the mobile's receiver terminal 1C displays at the display 112 the accumulated-latest-music reproduction/switch-over notification screen 123*c* (see FIG. 22). Then, the mobile's receiver terminal 1C decides whether audible output of the music content reproduced at S85 is already ended (S86) and, if it is not ended yet, continues processing of S85 until it ends and, otherwise, returns to the processing of S80.

If having decided at S81 that it did not fail to take any PES packet, on the other hand, the mobile's receiver terminal 1C decides that the digital broadcast signal DS can be received normally. Then, the mobile's receiver terminal 1C acquires the content data (hence music content data) of a program currently selected by the driver (or fellow passenger) from the TS based on the digital broadcast signal DS (S87), converts thus acquired program content data (hence music content data) into analog data, and then reproduces this analog data of the program content (music content), thus audibly outputting it from the speaker 111 (S88).

Furthermore, the mobile's receiver terminal 1C extracts from the TS based on the digital broadcast signal a content ID, content data of a music content having this content ID, etc. and accumulates them in the latest music accumulation DB120 (S89). Further, the mobile's receiver terminal 1C checks the service capacity of the latest music accumulation DB120 and, if overflow is expected to occur, deletes the accumulated content ID's, the corresponding music content data, etc. from the latest music accumulation DB120 starting from less recently accumulated ones (S90). Upon completion of the processing at S90, the mobile's receiver terminal 1C returns to S80 to repeat the above-mentioned processing.

By this mobile's receiver terminal 1C, even if the automobile cannot receive the digital broadcast signal DS normally when it has entered a tunnel or a building shade, the same music content as that audibly output according to the currently received digital broadcast signal DS could be retrieved from the latest music contents accumulated beforehand and then output audibly, thus avoiding the interruption of the audible output. Moreover, by this mobile's receiver terminal 1C, even if the same music content could not be retrieved, the latest music content accumulated beforehand can be output audibly.

Fourth Embodiment

The following will describe a fourth embodiment.

It is here to be noted that the internal configuration of a content distribution station 2D is the same as that of the content distribution station 2B of the second embodiment except some of the components and so its description is omitted.

Figure 23:
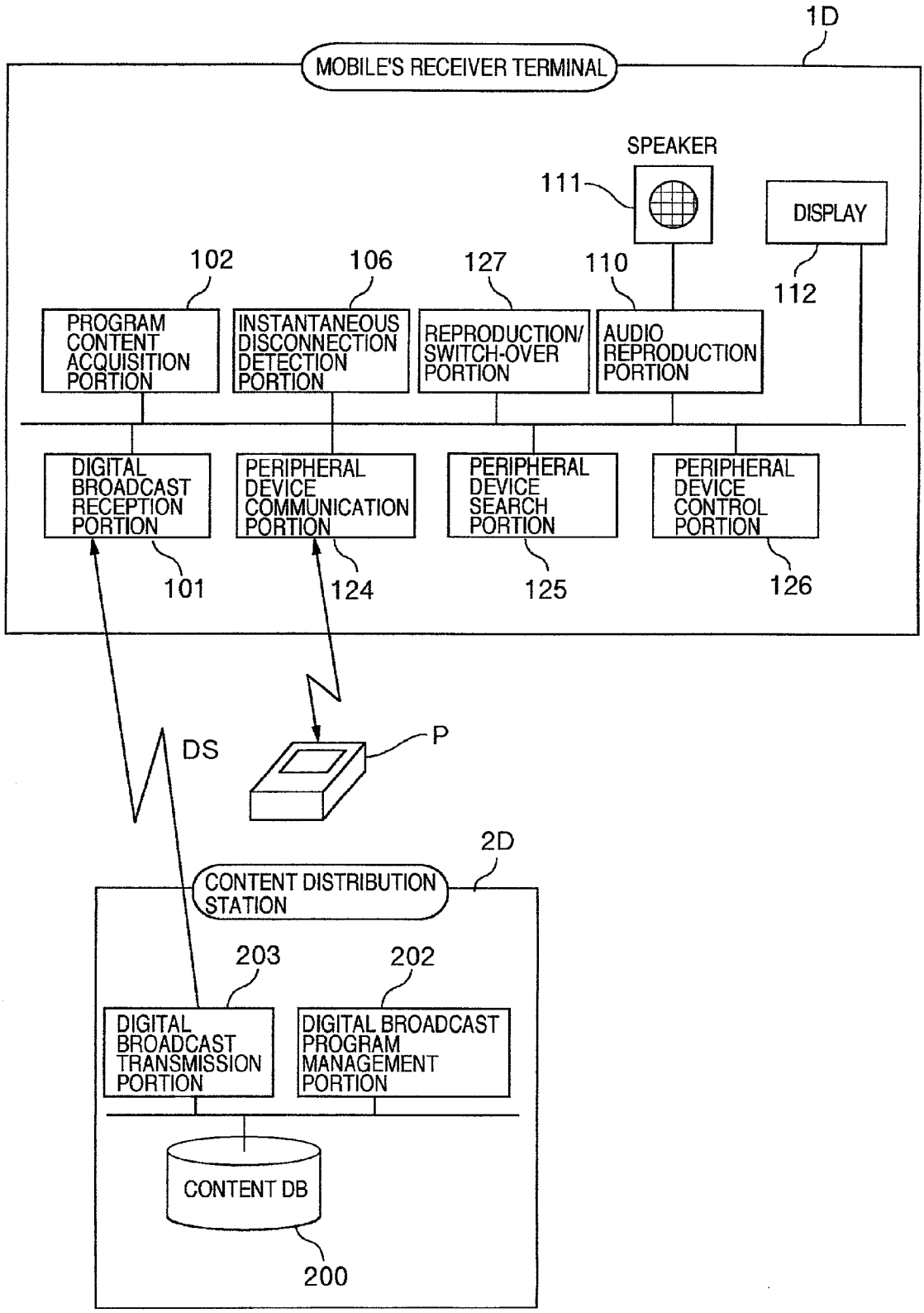
FIG. 23 is an internal configuration diagram for showing the mobile's receiver terminal and the content distribution station related to a fourth embodiment.

The following will describe a portable MP3 player P with reference to FIG. 23. FIG. 23 shows an internal configuration diagram of a mobile's receiver terminal 1D and a content distribution station 2D related to the fourth embodiment. The portable MP3 player P is portable and adapted to reproduce and audibly output a music content audio-compressed by a MPEG-1 Audio Layer-III. The portable MP3 player P is equipped with a wireless LAN (Local Area Network) communication device utilizing a weak infrared light and so can communicate, based on a peer-station concept, with any other communication device with a wireless LAN within a range of a few meters to a few tens of meters. Further, the portable MP3 player P can utilize communication by use of a wireless LAN to control such operations as reproduction, suspension, etc. from any other communication device, thus transmitting an audible output of reproduced music contents through the wireless LAN. It is here to be noted that the portable MP3 player P has an identification ID which indicates that it can transmit music contents through the wireless LAN and, when having received a search signal from any other communicating device, transmits this identification ID to it.

It is here to be noted that in the fourth embodiment, the portable MP3 player P corresponds to the claimed recorded-content reproducer.

The following will describe the internal configuration of the mobile's receiver terminal 1D. It is here to be noted that the same components of the mobile's receiver terminal 1D as those of the mobile's receiver terminal 1B of the second embodiment are indicated by the same reference symbols and their description is omitted here.

The mobile's receiver terminal 1D mainly comprises the digital broadcast reception portion 101, the program content acquisition portion 102, the instantaneous disconnection detection portion 106, a peripheral device communication portion 124, a peripheral device search portion 125, a peripheral device control portion 126, a reproduction/switch-over portion 127, and the audio reproduction portion 110. As such, the mobile's receiver terminal 1D is equipped with an MPU, a RAM, a variety of circuits, a memory, a reception antenna, a wireless LAN communication device, a user interface (operation portion), the speaker 111, the display 112, etc., which are not shown.

It is here to be noted that in the fourth embodiment, the instantaneous disconnection portion 106 corresponds to the claimed reception state detection means, the peripheral device communication portion 124 corresponds to the claimed communication means, the peripheral device search portion 125 corresponds to the claimed reproducer search means, the peripheral device control portion 126 corresponds to the claimed reproduction control means, and the reproduction/switch-over portion 127 corresponds to the claimed switch-over means.

The peripheral device communication portion 124 is described as follows.

The peripheral device communication portion 124 is equipped with a wireless LAN communication device utilizing a weak infrared light to communicate, based on the peer-station concept, with any other communication device equipped with a wireless LAN within a range of a few meter to a few tens of meters. The peripheral device communication portion 124 receives a music-content reproduction speech transmitted from a player (portable MP3 player P) capable of transmitting reproduced music contents.

The peripheral device search portion 125 is described as follows.

The peripheral device search portion 125 transmits through the peripheral device communication portion 124 a search signal for searching for a device capable of transmitting a reproduced music content. When having received an identification ID of such a device (portable MP3 player P) capable of transmitting music contents, the peripheral device search portion 125 then decides that it has the device capable of transmitting reproduced music contents in its periphery.

The peripheral device control portion 126 is described as follows.

The peripheral device control portion 126 transmits via the peripheral device communication portion 124 a control signal to a device (portable MP3 player P) capable of transmitting a reproduced music content to, for example, reproduce, suspend reproduction of the music contents and also instructs to transmit a reproduced speech of the music contents.

The reproduction/switch-over portion 127 is described as follows.

Figure 25:
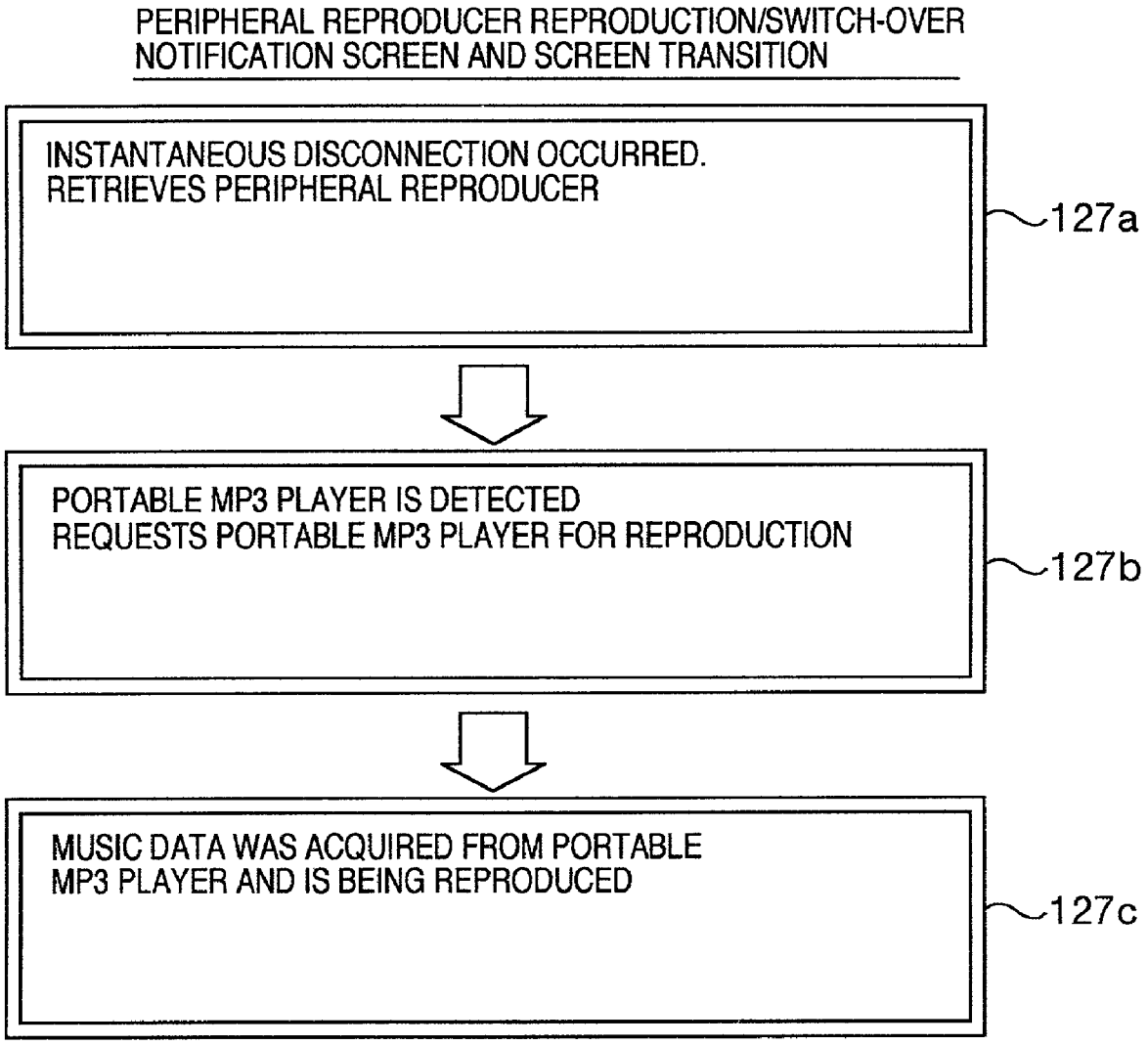
FIG. 25 is an illustration for showing the screen for posting reproduction/switch-over and the screen transition to a peripheral reproducer displayed at the display of the mobile's receiver terminal of FIG. 23.

The reproduction/switch-over portion 127 switches a content to be output audible, based on a reception state of the digital broadcast signal DS. Specifically, when the instantaneous disconnection detection portion 106 decides that the digital broadcast signal DS can be received normally, the reproduction switch-over portion 127 determines the content of a program acquired by the program content acquisition portion 102 as a content to be output audibly. If the instantaneous disconnection detection portion 106 decides that the digital broadcast signal DS cannot be received normally, on the other hand, the reproduction/switch-over portion 127 finds a device capable of transmitting reproduced music content and then switches the audible output-subject content to reproduced music contents received from thus found device (portable MP3 player P). To audibly output the reproduced music content sent from the device capable of transmitting reproduced music contents, the reproduction/switch-over portion 127 notifies the driver etc. of that information by displaying at the display 112 a instantaneous disconnection occurrence, a reproducer search notification screen 127*a*, peripheral reproducer detection, and a reproduction request notification screen 127*b*, a peripheral-reproducer reproduction switch-over notification screen 127*c* (see FIG. 25). FIG. 25 shows the screen notifying the peripheral reproducer of reproduction switch-over and the screen transition displayed at the display 112 of the mobile's receiver terminal 1D.

Figure 24:
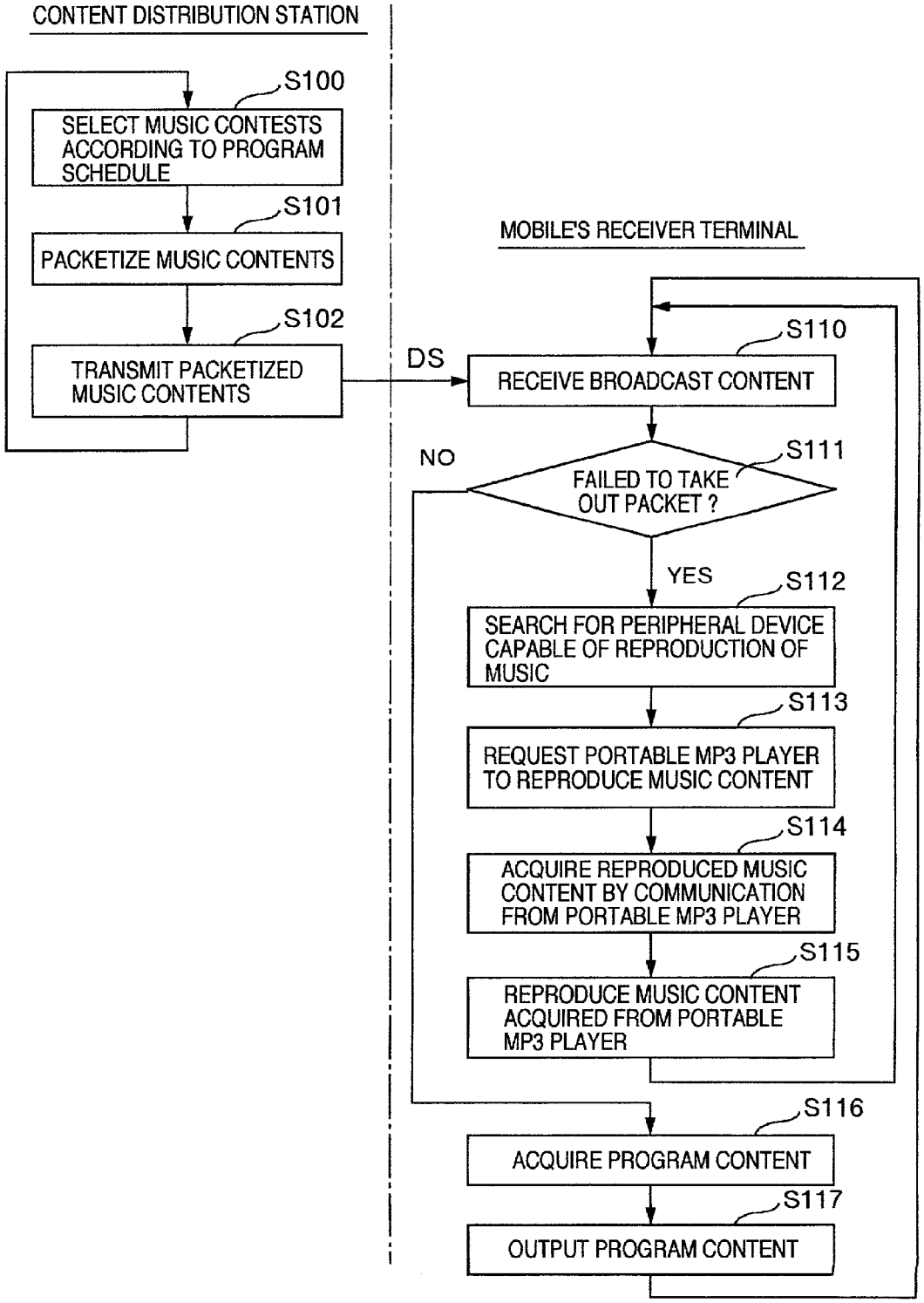
FIG. 24 is a flowchart for showing the main processing executed at the mobile's receiver terminal and the content distribution station of FIG. 23.

The following will describe the main processing executed at the mobile's receiver terminal 1D and the content distribution station 2D along a flowchart of FIG. 24 with reference to FIGS. 1, 23, and 25. FIG. 24 shows the flowchart of the main processing executed at the mobile's receiver terminal 1D and the content distribution station 2D.

The content distribution station 2D creates a program schedule to make a program according to this program schedule. Then, the content distribution station 2D stores the content data (including music content data) of this made program in the content DB200.

The mobile's receiver terminal 1D, on the other hand, selects a music content to be performed in a program according to the program schedule from the content DB200 (S100).

Further, the content distribution station 2D sub-divides an individual stream of the music content into a plurality of PES packets (S101).

Subsequently, the content distribution station 2D multiplexes the PES packets of these many contents to thereby create a TS, modulates this TS into a digital broadcast signal DS that fits satellite broadcasting or ground-wave broadcasting, and then transmits this digital broadcast signal DS through the transmission antenna to the artificial satellite AS or the radio wave tower RT (S102). Upon completion of processing at S102, the content distribution station 2D returns to S100 to repeat the above-mentioned processing.

The mobile's receiver terminal 1D, on the other hand, receives the digital broadcast signal DS carrying those many contents transmitted from the artificial satellite AS or the radio wave tower RT (Silo).

The mobile's receiver terminal 1D converts the digital broadcast signal DS into the TS and then decides whether it failed to take out any PES packet based on its CRC flag contained in each TS packet (Sill).

If having decided at S111 that it failed to take out a PES packet, the mobile's receiver terminal ID decides that the digital broadcast signal DS cannot be received normally and searches its periphery for a device that can transmit a reproduced music content (S112). At the same time, the mobile's receiver terminal 1D displays at the display 112 the instantaneous disconnection occurrence and the reproducer search notification screen 127*a*.

When having received the identification ID from the portable MP3 player P, the mobile's receiver terminal 1D transmits a request for reproduction of a music content to the portable MP3 player P and also transmits a request for transmission of the music content thus reproduced (S113). At the same time, the mobile's receiver terminal 1D displays at the display 112 the detection of the portable MP3 player P and the reproduction request notification screen 127*b* (see FIG. 25).

Then, the portable MP3 player P starts to reproduce the music content and also transmit the music content this reproduced. The mobile's receiver terminal 1D receives this reproduced music content (S114) and outputs it audibly from the speaker 111 (S115). At the same time, the mobile's receiver terminal 1D displays at the display 112 the screen 127*c* for notifying of reproduction/switch-over by the portable MP3 player P (see FIG. 25). Upon completion of the audible output at S115, the mobile's receiver terminal 1D returns to the processing at S110.

If having decided at S111 that it did not fail to take any PES packet, on the other hand, the mobile's receiver terminal 1D decides that the digital broadcast signal DS can be received normally. Then, the mobile's receiver terminal 1D acquires the content data of a program (channel) currently selected by the driver (or fellow passenger) from the TS based on the digital broadcast signal DS (S116), converts thus acquired program content data into analog data, and reproduces this analog data of the program content, thus audibly outputting it from the speaker 111 (S117). Upon completion of the processing at S117, the mobile's receiver terminal 1D returns to S110 to repeat the above-mentioned processing.

By this mobile's receiver terminal 1D, even if the automobile cannot receive the digital broadcast signal DS normally when it has entered a tunnel or a building shade, it is possible to communicate with a peripheral device capable of reproducing a music content to thereby audibly output the reproduced music content sent from this peripheral device, thus avoiding the interruption of the audible output. Moreover, by this mobile's receiver terminal 1D, it is possible to acquire music contents from the peripheral device, thus eliminating the necessity of accumulating the music contents.

Fifth Embodiment

The following will describe a fifth embodiment.

It is here to be noted that the internal configuration of a content distribution station 2E is the same as that of the content distribution station 2C of the third embodiment and so its description is omitted.

Figure 26:
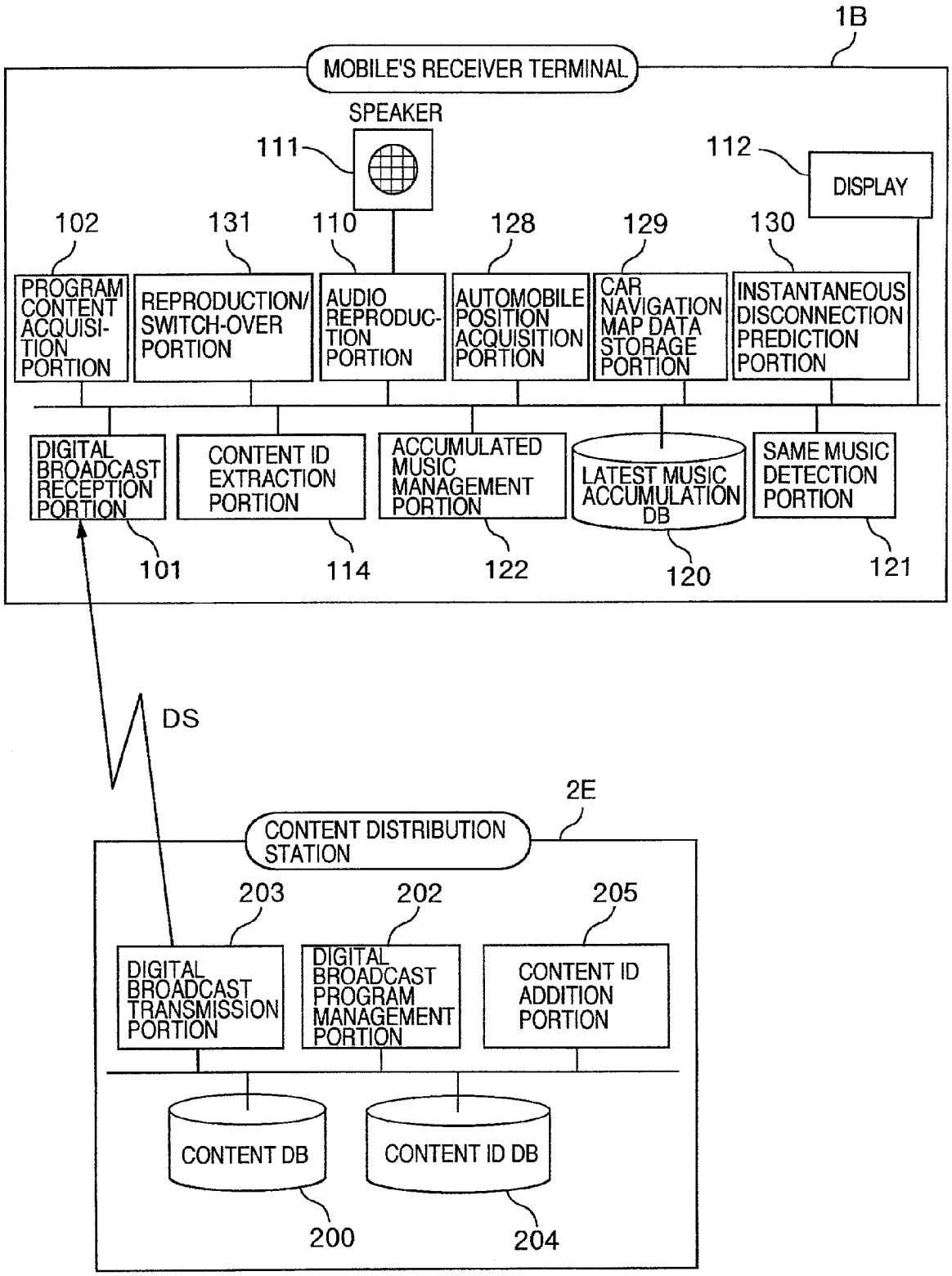
FIG. 26 is an internal configuration diagram for showing the mobile's receiver terminal and the content distribution station related to a fifth embodiment.

The following will describe the internal configuration of a mobile's receiver terminal 1E with reference to FIG. 26. It is here to be noted that the same components of the mobile's receiver terminal 1E as those of the mobile's receiver terminal 1C of the third embodiment are indicated by the same reference symbols and their description is omitted. FIG. 26 shows the internal configuration of the mobile's receiver terminal 1E and the content distribution station 2E related to the fifth embodiment.

The mobile's receiver terminal 1E mainly comprises the latest music accumulation DB120, the digital broadcast reception portion 101, the program content acquisition portion 102, the content ID extraction portion 114, an automobile position acquisition portion 128, a car navigation map data storage portion 129, an instantaneous disconnection prediction portion 130, the same music detection portion 121, the accumulated music management portion 122, the reproduction/switch-over portion 131, and the audio reproduction portion 110. As such, the mobile's receiver terminal 1E is equipped with an MPU, a RAM, a variety of circuits, a memory, a reception antenna, a GPS (Global Positioning System) reception antenna, a distance sensor, an orientation sensor, a user interface (operation portion), the speaker 111, the display 112, etc., which are not shown.

In the fifth embodiment, the latest music accumulation DB120 corresponds to the claimed content accumulation means, the automobile position acquisition portion 128 corresponds to the claimed current position acquisition means, the instantaneous disconnection predicting portion 130 corresponds to the claimed reception state predicting means, the same music detection portion 121 corresponds to the claimed same content detection means, and the reproduction/switchover portion 131 corresponds to the claimed switch-over means.

The automobile position acquisition portion 128 is described as follows.

The automobile position acquisition portion 128 is equipped with the GPS reception antenna, the distance sensor, and the orientation sensor to thereby acquire the current position of the automobile V. Specifically, the automobile position acquisition portion 128 calculates the current position by means of the GPS based on at least three GPS signals received through the GPS reception antenna. Furthermore, the automobile position acquisition portion 128 calculates the current position by means of self-contained navigation based on a travelling distance obtained with the distance sensor and an orientation obtained with the orientation sensor. Then, the automobile position acquisition portion 128 calculates a travelling locus and a travelling orientation by means of hybrid navigation based on the current position by means of the GPS and that by means of self-contained navigation. Further, the automobile position acquisition portion 128 performs map matching based on a travelling locus and an orientation of the automobile as well as map matching map data stored in the car navigation map data storage portion 129, thus calculating a current position, a travelling road, and a travelling direction.

The car navigation map data storage portion 129 is described as follows.

The car navigation map data storage portion 129 is comprised of an magneto-optical disk etc., for storing the digital map data for use in map matching and display for car navigation. This digital map data contains road data and data of on-the-road facilities such as tunnels as well as data of off-the-road buildings and railways.

The instantaneous disconnection prediction portion 130 is described as follows.

Figure 28:
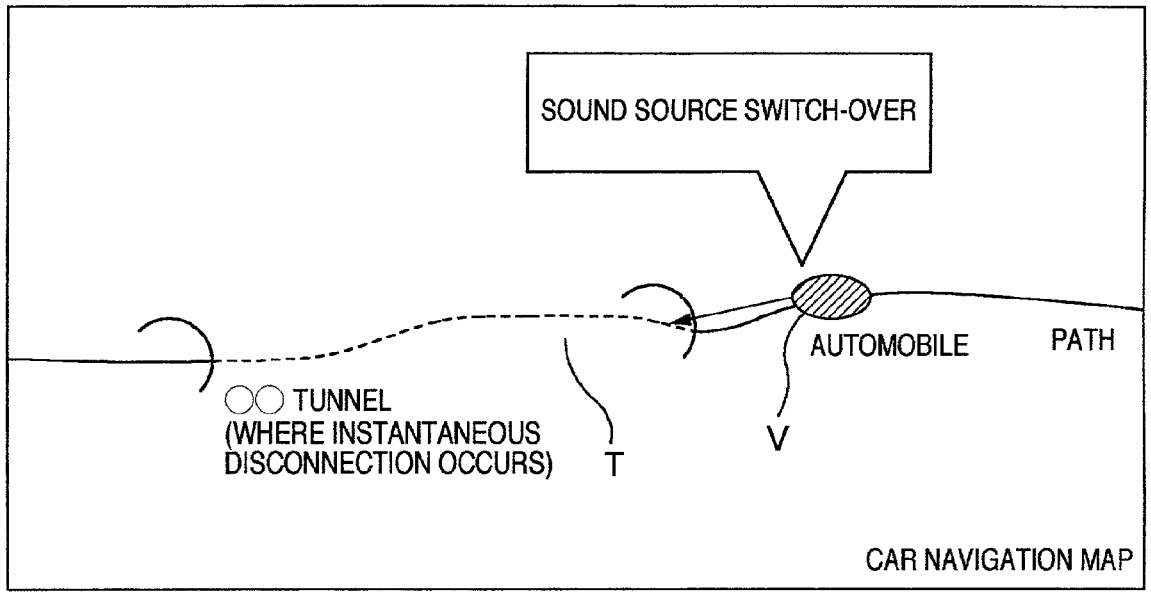
FIG. 28 is a schematic diagram for showing one example of a place where instantaneous disconnection occurred.

The instantaneous disconnection prediction portion 130 predicts whether the automobile will travel in a place where the digital broadcast signal DS cannot be received normally. Specifically, the instantaneous disconnection predicting portion 130 obtains the data of the on-the-road facilities, buildings, etc. expected to be encountered on its travelling road from the car navigation map data storage portion 129 based on the current position, the travelling road, and the travelling direction calculated by the automobile position acquisition portion 128. If there is any on-the-road facility such as a tunnel or a super-highway or a building expected to be encountered on the travelling road, the instantaneous disconnection predicting portion 130 then predicts that the digital broadcast signal DS cannot be received normally, to identify a position (on the road) where it cannot be received normally. If there is no obstacle against the normal reception of the digital broadcast signal DS on or along the road, on the other hand, it predicts that the digital broadcast signal DS can be received normally. For example, as shown in FIG. 28, if there is an oncoming tunnel T on the road on which the automobile V is travelling, it predicts that the digital broadcast signal DS cannot be received normally at the position of the tunnel T. FIG. 28 is a schematic diagram of one example of the instantaneous disconnection occurrence position.

The reproduction/switch-over portion 131 is described as follows.

The reproduction/switch-over portion 131 switches a content to be output audibly based on a predicted reception state of the digital broadcast signal DS. Specifically, if the instantaneous disconnection prediction portion 130 predicts that the digital broadcast signal DS can be received normally, the reproduction/switch-over portion 131 switches the audible output-subject content to the content of a program acquired by the program content acquisition portion 102.

Figure 29:
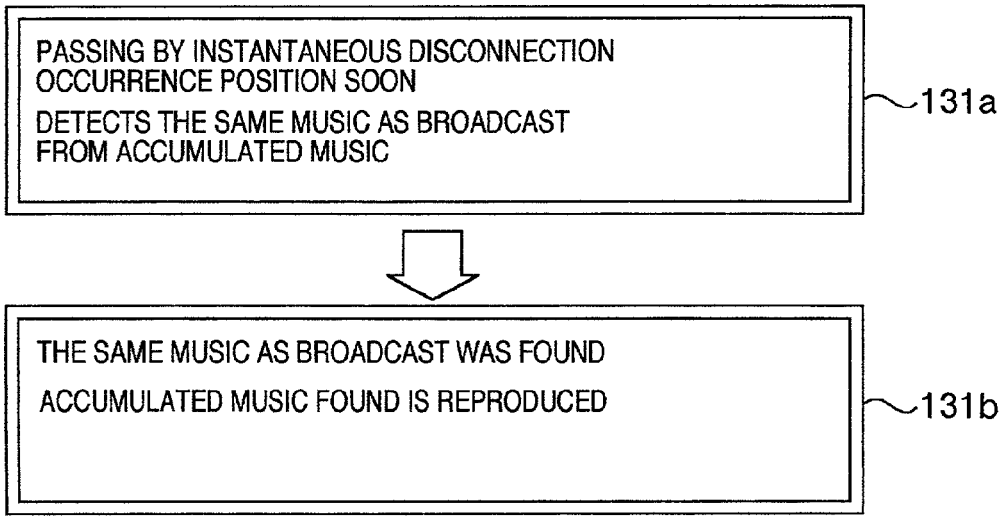
FIG. 29 is an illustration for showing the screen for posting reproduction/switch-over and the screen transition (in the case where the same music was found) to accumulated music based on a result of expected instantaneous disconnection displayed at the display of the mobile's receiver terminal of FIG. 26.

If the instantaneous disconnection detection portion 130 predicts that the digital broadcast signal DS cannot be received normally, the reproduction/switch-over portion 131 switches the audible output-subject content to such music content data that is retrieved and extracted by the same music detection portion 121 before a reception-disabled position is reached. If the same music content as that audibly output currently can be output audibly, the reproduction/switch-over portion 131 notifies the driver etc. of that information by displaying at the display 112 a screen 131*a* for posting that an instantaneous disconnection occurrence position is being passed by soon and that the same music as that being broadcast is detected from the accumulated music and then a screen 131*b* for posting that the same music is reproduced (see FIG. 29). FIG. 29 shows the accumulated-music reproduction/switch-over notification screen and the screen transition (in the case where the same music was found) based on a result of instantaneous disconnection prediction displayed at the display 112 of the mobile's receiver terminal 1E.

Figure 30:
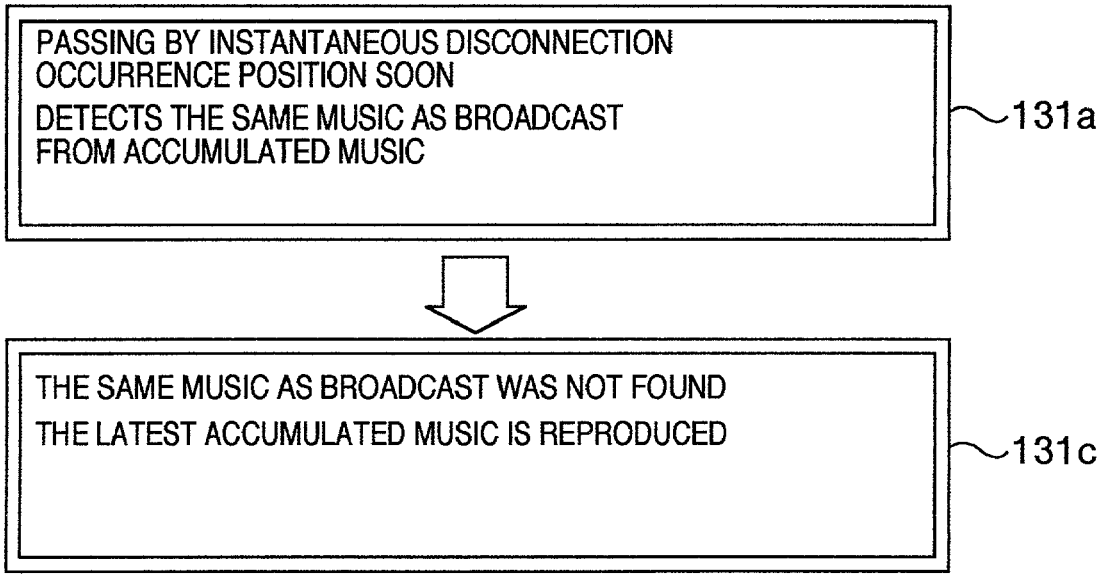
FIG. 30 is an illustration for showing the screen for posting reproduction/switch-over and the screen transition (in the case where the same music was not found) to accumulated music based on a result of expected instantaneous disconnection displayed at the display of the mobile's receiver terminal of FIG. 26.

If the same content ID could not be retrieved by the same music detection portion 121, however, the reproduction/switch-over portion 131 takes out music content data of the music contents accumulated in the latest music accumulation DB120 starting from the more recently accumulated ones and switches the audible output-subject content to thus taken out content data before the reception-disabled position is reached. To output the latest music content audibly, the reproduction/switch-over portion 131 notifies the driver etc. of that information by displaying at the display 112 the screen 131*a* for posting that an instantaneous disconnection occurrence position is being passed by soon and that the same music as that being broadcast is detected from the accumulated music and then a screen 131*c* for posting that the latest music is reproduced (see FIG. 30). FIG. 30 shows the accumulated-music reproduction/switch-over notification screen and the screen transition (in the case where the same music was not found) based on a result of instantaneous disconnection prediction displayed at the display 112 of the mobile's receiver terminal 1E.

Figure 27:
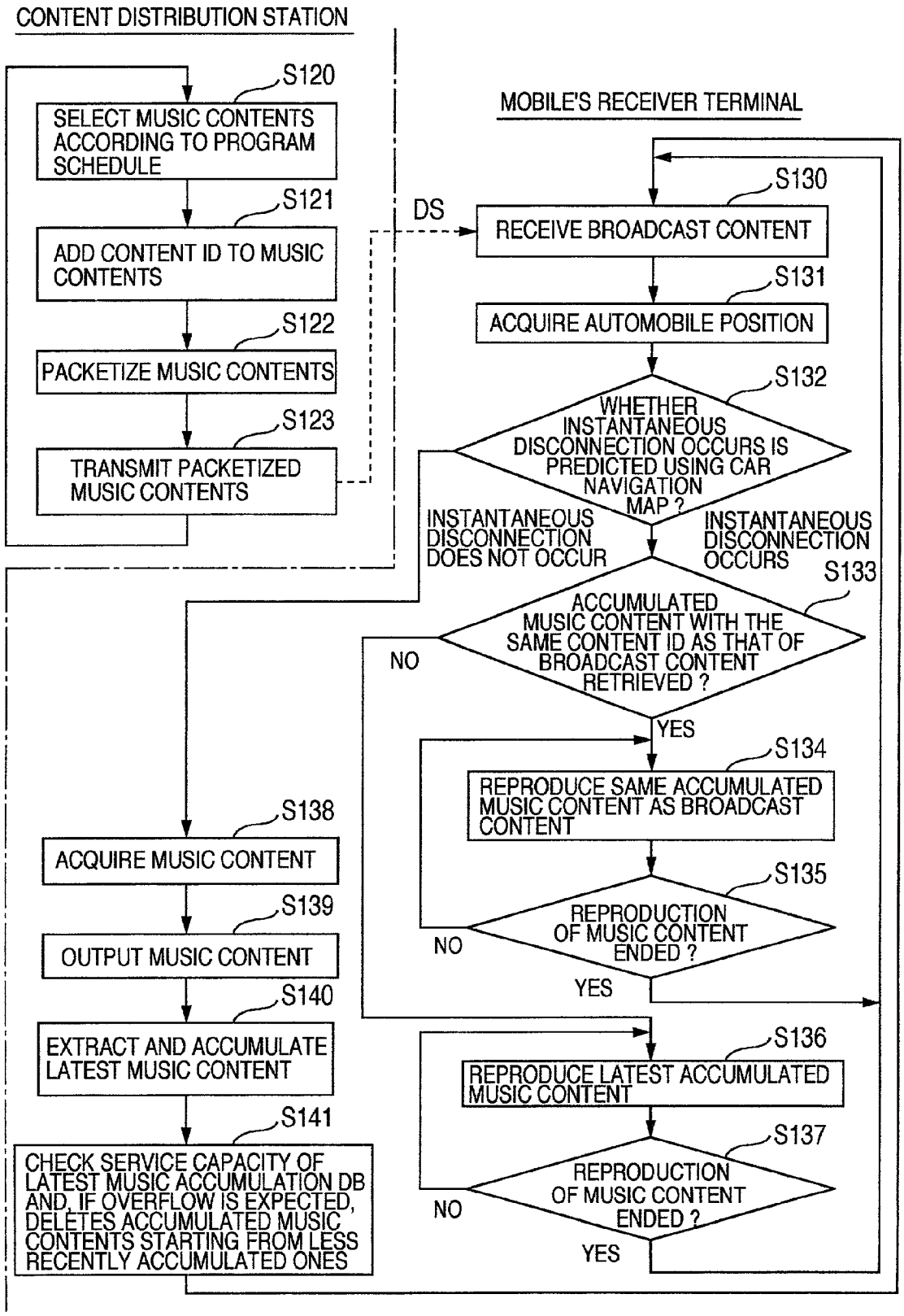
FIG. 27 is a flowchart for showing the main processing executed at the mobile's receiver terminal and the content distribution station of FIG. 26.

The following will describe the main processing executed at the mobile's receiver terminal 1E and the content distribution station 2E along a flowchart of FIG. 27 with reference to FIGS. 1, 26, 28, 29, and 30. FIG. 27 shows the flowchart of the main processing executed at the mobile's receiver terminal 1E and the content distribution station 2E.

The main processing (S120–S123) executed by the content distribution station 2E is the same as that (S40–S43) executed by the content distribution station 2B of the second embodiment and that (S70–S73) executed by the content distribution station 2C of the third embodiment and so its description is omitted here.

The mobile's receiver terminal 1E, on the other hand, receives the digital broadcast signal DS carrying many contents transmitted from the artificial satellite AS or the radio wave tower RT (S130).

The mobile's receiver terminal 1E then calculates its current position, travelling road, and travelling direction based on a travelling distance obtained with the distance sensor, an orientation obtained with the orientation sensor, and the map data (S131).

Further, the mobile's receiver terminal 1E predicts whether there is an oncoming position (instantaneous disconnection position) on the travelling road where the digital broadcast signal DS cannot be received normally based on these calculated current position, travelling road, and travelling direction as well as the data of, for example, oncoming facilities on and buildings along the travelling road (S132).

If it predicts at S132 that there is an instantaneous disconnection position, the mobile's receiver terminal 1E retrieves from among the music contents accumulated in the latest music accumulation DB120 such a music content that has the same content ID as that of a music content audibly output by the currently received digital broadcast signal DS (S133). At the same time, the mobile's receiver terminal 1E displays at the display 112 the screen 131*a* for posting that the instantaneous disconnection position is being passed by soon and that the same music as that being broadcast is retrieved (see FIGS. 29 and 30).

If the music content with the same content ID could be retrieved at S133, the mobile's receiver terminal 1E converts the content data of the retrieved music content into a analog data and reproduce it, thus outputting it from the speaker 111 audibly (S134). At the same time, the mobile's receiver terminal 1E displays at the display 112 the screen 131*b* posting the reproduction/switch-over of the same music as that accumulated (see FIG. 29). Then, the mobile's receiver terminal 1E decides whether the audible output of the music content reproduced at S134 is ended already (S135) and, if it is yet to be ended, continues the processing of S134 until it ends and, otherwise, returns to the processing of S130.

If the music content with the same content ID could not be retrieved at S133, however, the mobile's receiver terminal 1E takes out content data of the music contents accumulated in the latest music accumulation DB120 starting from the more recently accumulated ones, converts thus taken out content data into analog data, and then reproduces the music content of this analog data to output it audibly from the speaker 111 (S136). At the same time, the mobile's receiver terminal 1E displays at the display 112 the screen 131*c* posting the reproduction/switch-over of the latest music of the accumulated music (see FIG. 30). Then, the mobile's receiver terminal 1E decides whether the audible output of the music content reproduced at S136 is already ended (S137) and, if it is not yet ended, continues the processing of S136 until it ends and, otherwise, returns to the processing of S130.

If it predicts at S132 that there is no instantaneous disconnection position, on the other hand, the mobile's receiver terminal 1E returns to processing of S138–S141. The processing of S138–S141 is the same as the main processing (S87–S90) by the mobile's receiver terminal 1C of the third embodiment and so its description is omitted. When the processing of S141 is completed, the mobile's receiver terminal 1E returns to S130 to repeat the above-mentioned processing.

By thus mobile's receiver terminal 1E, it is possible to utilize the car navigation function to thereby predict whether the digital broadcast signal DS can be received normally. By the mobile's receiver terminal 1E, even if an automobile mounted with it is predicted that it cannot receive the digital broadcast signal DS normally when it enters an oncoming tunnel or building's shade on the travelling road, it is possible to avoid interruption of the audible output by audibly outputting the latest music content or the same music content as that audibly output by the currently received digital broadcast signal DS.

Although the embodiments of the present invention have been described, the present invention is not limited thereto and may have any other various ones.

For example, although the above-mentioned embodiments exemplified a case where the reception of the digital broadcast signal is disabled while the automobile is travelling, the present invention is applicable also to a case where the digital broadcast signal cannot be received due to a trouble in the digital broadcasting facilities or the artificial satellite.

Furthermore, although the above-mentioned embodiments have applied the digital broadcast receiver to a mobile's receiver terminal mounted to an automobile, it may be applied to a PDA or other mobile device, a portable digital broadcasting TV set, a digital broadcasting radio set, a mounting-type digital TV set, etc.

In addition, although the above-mentioned embodiments have exemplified music contents, it may be applicable to image contents, character contents, and others.

Although the fourth embodiment has exemplified a portable MP3 player as the recorded content reproducer, it may be any other types of players such as an MD player or CD player having a communication function or any other wireless communication function by use of Bluetooth other than a wireless LAN.

By the digital receiver of the present invention, it is possible to avoid interruption of output of a content even if the digital broadcast signal cannot be received normally, thus preventing the viewers from feeling uncomfortable.

It should be further understood by those skilled in the art that the foregoing description has been made on embodiments of the invention and that various changes and modifications may be made in the invention without departing from the spirit of the invention and the scope of the appended claims.

What is claimed is:

1. A digital broadcast receiver mounted to a mobile, for receiving a digital broadcast signal carrying many contents and also outputting the content based on said digital broadcast signal received, said digital broadcast receiver comprising:

content accumulation means for accumulating said received contents;

reception state detection means for detecting whether said digital broadcast signal can be received normally; and means for switching from an output of the received content to reproduction of the content accumulated in said content accumulation means if said reception state detection means detects that said digital broadcast signal cannot be received normally;

current position acquisition means for acquiring a current position of said mobile; and reception state predicting means for predicting whether said digital broadcast signal can be received normally based on the current position acquired by said current position acquisition means and map data, wherein said switch-over means switches an output-subject from said received contents to said reproduced content if said reception state prediction means predicts that said digital broadcast signal cannot be received normally.

2. The digital broadcast receiver according to claim 1, further comprising:

electronic program guide acquisition means for acquiring an electronic program guide from said digital broadcast signal;

program registration means for registering information of a viewer's favorite program based on said electronic program guide;

program information storage means for storing information of the program registered by said program registration means; and program extraction means for extracting the content of the program stored in said program registration means from said received contents to then accumulate the content of thus extracted program in said content accumulation means.

3. The digital broadcast receiver according to claim 1, further comprising:

content ID acquisition means for acquiring a content ID assigned to each content from said broadcast signal;

content ID registration means for registering the content ID of the viewer's favorite content;

content ID storage means for storing the content ID registered by said content ID registration means; and content extraction means for extracting from among said received contents the content having the content ID that coincides with the content ID stored in said content ID storage means and then accumulating thus extracted content in said content accumulation means.

4. The digital broadcast receiver according to claim 1, wherein said digital broadcast signal is transmitted via an artificial satellite.

5. The digital broadcast receiver according to claim 4, wherein said artificial satellite is a highly elliptic orbit satellite.

6. The digital broadcast receiver according to claim 1, wherein said digital broadcast signal is transmitted by digital terrestrial broadcasting.

* * * * *